US010933629B2

(12) United States Patent
Poulikakos et al.

(10) Patent No.: US 10,933,629 B2
(45) Date of Patent: Mar. 2, 2021

(54) PRINT PATTERN GENERATION ON A SUBSTRATE

(71) Applicant: ETH ZURICH, Zurich (CH)

(72) Inventors: Dimos Poulikakos, Zollikon (CH); Julian Schneider, Zurich (CH); Patrick Galliker, Horgen (CH)

(73) Assignee: ETH ZURICH, Zurich (CH)

( * ) Notice: Subject to any disclaimer, the term of this patent is extended or adjusted under 35 U.S.C. 154(b) by 0 days.

(21) Appl. No.: 16/519,940

(22) Filed: Jul. 23, 2019

(65) Prior Publication Data

US 2019/0344561 A1 Nov. 14, 2019

Related U.S. Application Data

(62) Division of application No. 15/567,512, filed as application No. PCT/EP2016/058711 on Apr. 20, 2016, now Pat. No. 10,518,527.

(30) Foreign Application Priority Data

Apr. 20, 2015 (EP) ..... 15164289

(51) Int. Cl.
*B41J 2/045* (2006.01)
*B41J 2/21* (2006.01)
*B41J 2/145* (2006.01)

(52) U.S. Cl.
CPC ..... *B41J 2/04505* (2013.01); *B41J 2/04586* (2013.01); *B41J 2/145* (2013.01); *B41J 2/2132* (2013.01)

(58) Field of Classification Search
CPC ..... B41J 2/04505; B41J 2/145; B41J 2/2132; B41J 2/04586
See application file for complete search history.

(56) References Cited

U.S. PATENT DOCUMENTS 6,547,355 B1 4/2003 Shimada et al.
6,604,806 B1 8/2003 Yamada
(Continued)

FOREIGN PATENT DOCUMENTS

EP 1 550 556 A1 7/2005
WO 2007/064577 A1 6/2007

OTHER PUBLICATIONS

International Search Report for PCT/EP2016/058711, dated Oct. 4, 2016 (PCT/ISA/210).
(Continued)

*Primary Examiner* — Sharon Polk
(74) *Attorney, Agent, or Firm* — Sughrue Mion, PLLC

(57) ABSTRACT

A method of printing a print pattern onto a substrate with a print head comprises a plurality of nozzles, where the print head has a rectangular active print head area which includes all of the nozzles. The active print head area is delimited by four sides defining a primary and a secondary direction. The method comprises i) decomposing the print pattern into a plurality of print pattern segments that have dimensions along the primary and secondary direction which are smaller than the dimensions of the active print head area along the primary and secondary direction; ii) assigning each print pattern segment to exactly one nozzle; iii) causing each nozzle to print the print pattern segment assigned to said nozzle. The print head is moved during printing of each print pattern segment within an area that is smaller than said active print head area.

14 Claims, 9 Drawing Sheets

(56) References Cited

U.S. PATENT DOCUMENTS

| | | | |
|---|---|---|---|
| 2005/0122354 | A1 | 6/2005 | Yamane et al. |
| 2010/0134549 | A1 | 6/2010 | Barbour |
| 2011/0187798 | A1 | 8/2011 | Rogers et al. |
| 2015/0029247 | A1 | 1/2015 | Hogan |
| 2018/0009223 | A1* | 1/2018 | Poulikakos ..... B41J 2/06 |

OTHER PUBLICATIONS

Written Opinion of the International Searching Authority for PCT/EP2016/058711, dated Oct. 4, 2016 (PCT/ISA/237).

* cited by examiner

PRINT PATTERN GENERATION ON A SUBSTRATE

This is a Divisional of application Ser. No. 15/567,512 filed Oct. 18, 2017 claiming priority based on International Application No. PCT/EP2016/058711 filed Apr. 20, 2016, claiming priority based on European Patent Application No. 15164289.9, filed Apr. 20, 2015, the contents of all of which are incorporated herein by reference in their entirety.

TECHNICAL FIELD

The present invention relates to a printing system and a method for printing a print pattern onto a substrate.

PRIOR ART

A variety of printing technologies have developed over time. Inkjet printing-based approaches are of interest for a number of reasons, e.g., functional inks can be deposited only where needed, and different functional inks are readily printed to a single substrate. For example, inkjet printing enables to directly pattern wide classes of materials ranging from organic or biological materials to solid materials dispersed in liquids and solvents. Moreover, inkjet printing can be employed for printing large areas on a substrate and is also versatile in that structure design changes can be employed through software-based printing control systems.

Some of the major problems related to ink-jet printing methods are the high pressures 25 required for the ejection of small droplets (where small refers to a size below a few tens of micrometers) and the difficulty of depositing these small droplets with high accuracy, respectively. Droplets being smaller than 10 micrometers are easily decelerated and deflected by their gaseous environment. Furthermore, the droplets ejected by liquid pressurization are generally equally large or even larger than the nozzle they are ejected 30 from. Therefore, in order to obtain small droplets, small nozzles are required which, however, suffer from the well-known problem of getting clogged easily.

Electrohydrodynamic jet printers differ from ink-jet printers in that they use electric fields to create fluid flows for delivering ink to a substrate. Especially, electrohydrodynamic printing enables the printing of droplets at much higher resolution than compared to ink-jet printing. A common set-up for electrohydrodynamic jet printing involves establishing an electric field between nozzles containing ink and the substrate to which the ink is transferred. This can be accomplished by connecting each of the nozzles to a voltage power supply.

High-resolution electrohydrodynamic ink-jet printing systems and related methods for printing functional materials on a substrate surface are disclosed in US 2011/0187798, where, e.g., a nozzle is electrically connected to a voltage source that applies an electric charge to the fluid in the nozzle to controllably deposit the printing fluid on the surface, and wherein the nozzle has a small ejection orifice such that nanofeatures or microfeatures can be printed.

EP 1 550 556 A1 discloses a method for producing an electrostatic liquid jetting head comprising a nozzle plate and a driving method for driving the electrostatic liquid jetting head. When a voltage is applied to a plurality of jetting electrodes arranged on a base plate, droplets are ejected from a plurality of nozzles that are arranged on the electrostatic liquid jetting head.

WO 2007/064577 A1 discloses a common stimulation electrode, which, in response to an electrical signal, synchronously stimulates all members of a group of fluid jets emitted from corresponding nozzle channels to form a corresponding plurality of continuous streams of drops.

NanoDrip printing, i.e., the printing of nanoscale droplets, allows a printing resolution of better than 100 nm. If, however, a large area shall be printed at such a high resolution within a reasonable time, the print head would have to be scanned with a velocity in the range of tens of millimeters per second or even meters per second, and the nanoscale droplets could no longer be deposited on the substrate with sufficient accuracy. In addition, in order to deposit droplets within a spacing of about 100 nm at a scan velocity of one meter per second, the droplet ejection would require an ejection frequency of around 10 MHz.

Because the droplets are small in NanoDrip printing, these droplets only cover a very small area on the substrate they are printed on. In order to print a large area on a substrate at industrially relevant throughput, a multitude of densely arranged nozzles is needed compared to ink-jet printing or electrohydrodynamic printing performed at a low resolution, while at the same time cross-talk between such densely arranged nozzles and between the droplets they eject, must be prevented, such that nozzles can be individually addressed and droplets be deposited on a substrate with high accuracy.

The printing throughput of an ink-jet print head directly depends on the printing resolution it has to achieve because every droplet covers an every smaller area segment of the substrate when said droplet becomes smaller. In order to keep up with printing throughput while the printing resolution is increased therefore requires print heads that have a higher nozzle count.

Patent application No. EP 15153061.5 of January 2015, which was filed before the priority date of the present application but will be published only thereafter, discloses a printing system that enables high-resolution printing based on electrohydrodynamic effects from a print head comprising densely arranged nozzles. Said nozzles are associated with extraction electrodes, where a particular extraction electrode can be selectively turned on or off, depending on whether droplet ejection from the associated nozzle is intended or not. This switched-on/-off state can be different for any individual extraction electrode of the plurality of extraction electrodes at a given point in time. The disclosure of EP 15153061.5 is incorporated herein by reference in its entirety for teaching a print head comprising a plurality of nozzles with associated extraction electrodes for high-resolution electrohydrodynamic printing.

In order to cover large surface areas at high resolution, millions of such densely arranged nozzles are required, if the printing system is to complete printing of the print pattern within a reasonable time. Ink-jet printing generally offers the advantage of digital printing, meaning that every nozzle can be individually addressed such that the print head is not restricted to a specific print pattern. If, however, millions of nozzles are to be addressed at high-enough voltages for electrohydrodynamic actuation, it becomes technically impractical to address every nozzle individually, and hence common ink-jet print heads are generally restricted to a number of a few thousand nozzles. If this number is to be substantially increased, instead of individually addressing every nozzle, the print head may instead be built as a specific template to the print pattern that is to be produced. Working with templates is indeed a common practice in high-resolution patterning, for example by the methods referred to as photolithographic patterning. A print head being formed as a template to at least one specific print pattern can contain nozzles that are actuated by identical voltage signals. This, however, requires for optimal arrangement of said nozzles and their associated electrodes as well as an effective printing operation in order to enable efficient printing.

SUMMARY OF THE INVENTION

It is an object of the present invention to provide a method that enables printing of a large print pattern onto a substrate at a high printing-resolution.

In particular, the invention provides a method of printing a print pattern onto a substrate with a print head comprising a plurality of nozzles, the print head having a rectangular active print head area which includes all of the nozzles, the active print head area being delimited by four sides defining a primary and a secondary direction, the method comprising:

- decomposing the print pattern into a plurality of print pattern segments that have dimensions along the primary and secondary direction which are smaller than the dimensions of the active print head area along the primary and secondary direction;
- assigning each print pattern segment to exactly one nozzle;
- causing each nozzle to print the print pattern segment assigned to said nozzle,
- wherein the print head is moved during printing of each print pattern segment within an area that is smaller than said active print head area.

Due to the small magnitude of the print head movements, the maximum velocity of said movements can be very small, enabling exact movement trajectories of the print head with high accuracy, i.e. a high printing-resolution, while still providing a quick generation of the print pattern on the substrate, i.e. a fast printing, due to the large number of nozzles which are printing their assigned print pattern segments.

The print pattern segment preferably has dimensions that are at least 10 times smaller than the dimensions of the active print head area along the primary and secondary directions and the nozzles are preferably positioned on the print head in an arrangement that corresponds to the arrangement of their assigned print pattern segments on the substrate.

For example, if the layout of the print pattern segments to be printed by the assigned nozzles is desired to have a shape of a (n×m)-matrix, said assigned nozzles are preferably positioned on the print head in an arrangement that corresponds to said (n×m)-matrix arrangement of the assigned print pattern segments.

It is preferred that the print pattern comprises at least one group of nozzles that print their respective print pattern segments while being controlled by a common first triggering sequence that conveys a temporal sequence of voltage signals. That is to say, that the print pattern preferably comprises at least one group of identically printed print pattern segments, and all nozzles assigned to the print pattern segments of said group are simultaneously activated with a first triggering sequence. All nozzles assigned to said group can be controlled by a first common electric contact point, said first common electric contact point supplying the first triggering sequence.

The print pattern can comprise at least one further group of nozzles that print their respective further print pattern segments, wherein all nozzles assigned to the further print pattern segments of said further group are simultaneously activated with a common further triggering sequence. In other words, the print pattern preferably comprises at least one further group of identically printed print pattern segments, wherein all nozzles assigned to the further print pattern segments of said further group are simultaneously activated with a further triggering sequence.

At least one further print pattern can be formed after performing a translational movement between the print head and the substrate, wherein the translational movement moves the print head or the substrate beyond the at least one print pattern being printed beforehand by the print head.

The print head preferably comprises a plurality of extraction electrodes as disclosed in patent application No. EP 15153061.5, wherein each of the extraction electrodes is associated with a particular nozzle, and wherein voltages are applied to the extraction electrodes so as to cause an electrohydrodynamic ejection of droplets from the associated nozzles.

The print head can comprise a plurality of conductive tracks that electrically contact the extraction electrodes, wherein each of the conductive tracks is connected with a particular extraction electrode, and wherein every conductive track terminates on a contact point, the conductive track connecting the extraction electrodes associated with nozzles of the same nozzle group with the same contact point, and wherein the number of contact points comprised on the print head preferably is at least 10 contact points, more preferably at least 100 contact points.

The print pattern segment can be formed as a vector graphic being composed of primitive objects that are printed by a nozzle during a relative movement between the print head and the substrate while the nozzle is activated or deactivated by applying a voltage to its associated extraction electrode, the applied voltage preferably being in the form of a voltage triggering sequence, wherein the primitive objects preferably have a length along the primary and/or secondary direction being smaller than the diameter of the nozzle, more preferably it is smaller than one fifth of the nozzle diameter.

At least part of the nozzles associated with a common contact point may have different nozzle diameters such that said nozzles eject droplets having a different droplet diameter when the same voltage is applied to their associated extraction electrodes.

Preferably, at least one rectangular unit cell is defined for each print pattern segment, said unit cell defining a boundary around said print pattern segment, the rectangular unit cell being delimited by four unit cell sides defining a primary unit cell direction and a secondary unit cell direction, two of the unit cell sides being connected with each other at a common corner point, the primary and secondary unit cell directions corresponding to two preferred movement directions performed by the print head or by the substrate during printing.

For instance, if a print pattern segment is desired to have the shape of an "L", two of the unit cell sides defined for said "L"-shaped print pattern segment are preferably delimiting the "L".

At least one further print pattern may be printed after performing a repositioning movement between the print head and the substrate, wherein the repositioning movement moves the print head or the substrate by a distance that is smaller than the size of the active print head area along the primary and secondary dimensions, wherein the nozzles assigned to the at least one further print pattern are formed on the print head based on a projection of the respective unit cells that are shifted from the projection of the unit cells associated with the nozzles that print the first print pattern, and wherein said shift is equal in distance to the length of the repositioning movement.

A particular nozzle associated with a particular print pattern segment can be located on one of the unit cell sides or at the center of the unit cell, preferably at the corner point, of the unit cell that is associated with said print pattern segment when the unit cell is projected onto the print head, and wherein nozzles associated with unit cells of identical unit cell directions are preferably located at a position which corresponds to the same location as said particular nozzle with respect to their associated projected unit cells.

Preferably, at least two adjacent nozzles are arranged in a nozzle row in order to print at least one first primitive object that is longer than the distance between said adjacent nozzles, and wherein said at least one first primitive object is printed by applying a common voltage to the nozzles of the nozzle row simultaneously while performing a relative movement along the alignment direction of said nozzles.

At least one further primitive object of a different orientation is preferably printed by a nozzle after the same nozzle has printed the at least one first primitive object, wherein the respective print pattern segment associated with the at least one first and the at least one further primitive object are defined by at least two unit cells, said at least two unit cells preferably having a common corner point.

A patch comprising at least two primitive objects that are overlapped along the secondary unit cell direction can be generated by i) printing a first primitive object along the primary unit cell direction, ii) offsetting the relative print head or substrate position along the secondary unit cell direction by an offset distance to an offset position, the offset distance being smaller than the width of said first primitive object, and iii) printing a second primitive object at the offset position, said second primitive object overlapping with said first primitive object.

The patch can be extended by printing further primitive objects to said patch until the total length of the accumulated primitive objects along the secondary unit cell direction is identical to the length of the unit cell along the secondary unit cell direction, and wherein a unit pixel is generated if the total length of all accumulated primitive objects along the primary unit cell direction is identical to the length of the primary unit cell direction.

The patch can be extended beyond the circumference of the unit cell along its secondary unit cell direction by combining the patches that are printed by at least two adjacent nozzles of a nozzle array, wherein the nozzle array is formed by closely arranging said adjacent nozzles, preferably of the same alignment direction, along the secondary unit cell direction, the width of the unit cell sides along the secondary unit cell direction being smaller than half of the width of the primitive object.

A particular nozzle associated with a particular print pattern segment preferably overprints at least part of a neighboring print pattern segment.

A further extraction electrode can be associated with a particular nozzle, and a further voltage can be applied to said further extraction electrode such that droplets are only ejected from said particular nozzle if the voltages are supplied to both of its two associated extraction electrodes simultaneously, the applied further voltage preferably being in the form of a further voltage triggering sequence.

The present invention further provides a printing system for printing a print pattern onto a substrate comprises a print head and a print controller, wherein the print head comprises:

a plurality of nozzles;

a rectangular active print head area which includes all of the nozzles, the active print head area being delimited by four sides defining a primary and a secondary direction; and a plurality of extraction electrodes;

wherein the print controller is configured to carry out the following steps:

decomposing the print pattern into a plurality of print pattern segments that have dimensions along the primary and secondary direction which are smaller than the dimensions of the active print head area along the primary and secondary direction;

assigning each print pattern segment to exactly one nozzle;

causing each nozzle to print the print pattern segment assigned to said nozzle, and moving the print head during printing of each print pattern segment within an area that is smaller than said active print head area.

The printing system can be used for printing the print pattern onto the substrate according to the above-described method. All considerations disclosed herein in connection with the above-described method also apply to the disclosed printing system.

In particular, it is preferable that the print pattern segment has dimensions that are at least 10 times smaller than the dimensions of the active print head area along the primary and secondary directions and that the nozzles are arranged on the print head in an arrangement that corresponds to the arrangement of their assigned print pattern segments on the substrate.

The nozzles are preferably arranged as at least one group, said at least one group of nozzles being configured to print their respective print pattern segments during an identical movement between the print head and the substrate, wherein the extraction electrodes of all nozzles of the same group of nozzles are connected to a common electric contact point, and wherein said first common electric contact point receives a triggering sequence. The printing system can further comprise a plurality of conductive tracks that electrically contact the extraction electrodes, wherein each of the conductive tracks is connected with a particular extraction electrode, wherein every conductive track terminates on a contact point, the conductive track originating from the extraction electrodes associated with nozzles of the same nozzle group being contacted to the same contact point, and wherein, the number of contact points comprised on the print head preferably being at least 10 contact points, more preferably at least 100 contact points.

In another aspect, the present invention provides a printing system for printing a print pattern onto a substrate comprises a print head and a print controller, wherein the print head comprises:

at least one nozzle; and at least two extraction electrodes being associated with the at least one nozzle;

wherein the print controller is configured to jointly activate the extraction electrodes in order to cause an electrohydrodynamic ejection of droplets from said nozzle.

The joint activation of the extraction electrodes enables a simplified addressing of the extraction electrodes. For example, the print head can comprise nine nozzles which are arranged in three nozzle rows, wherein the first extraction electrodes of all nozzles being part of the same nozzle row are thereby contacted to the same contact point. At the same time, nozzles that are vertically aligned to each other have their second extraction electrode also contacted to the same contact point. Thereby, a particular nozzle will only print if both of its first and second extraction electrodes are activated. As a result of the two extraction electrodes being assigned to one nozzle, the overall electrical signal received by said nozzle is decoupled and partly provided by the first extraction electrode and partly provided by the second extraction electrode such that the nozzle is subjected to two essentially independent electrical triggering sequences. As a consequence, the number of contact points can be reduced which also simplifies the addressing of the extraction electrodes.

Preferably, the voltages applied to the two extraction electrodes are chosen such that the average electric field strength is essentially identical to the case where only one extraction electrode is assigned to the nozzle.

It is particularly preferable that the printing system according to this aspect comprises at least two conductive tracks that electrically contact the at least two extraction electrodes and at least two contact points, wherein each of the conductive tracks is connected with a particular extraction electrode, and wherein every conductive track terminates on a contact point.

The at least two extraction electrodes associated with the at least one nozzle can terminate on different contact points, wherein the different contact points are configured to receive a first and a further triggering sequence, and wherein the print controller is configured to provide the first and the further triggering sequence in such a manner that the superposed electric fields of the first and the further triggering sequence cause the ejection of droplets.

A method of printing a print pattern onto a substrate with a print head comprising at least one nozzle and at least two extraction electrodes associated with said nozzle comprises jointly activating the extraction electrodes to cause an electrohydrodynamic ejection of droplets from said nozzle.

The print head used in said method of printing preferably comprises at least two conductive tracks that electrically contact the extraction electrodes, wherein each conductive track is connected with a particular extraction electrode and terminates on a contact point, and wherein voltages are applied to the extraction electrodes so as to cause the ejection of droplets. Preferably, the at least two extraction electrodes associated with the at least one nozzle terminate on different contact points, wherein a first triggering sequence is applied to a first contact point and a further triggering sequence is applied to a further contact point, the superposed electric fields of the voltages conveyed by all the applied triggering sequences being above a minimal voltage necessary for the ejection of the droplets but wherein no droplet is being ejected if at least one triggering sequence conveys a non-zero voltage at a time.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
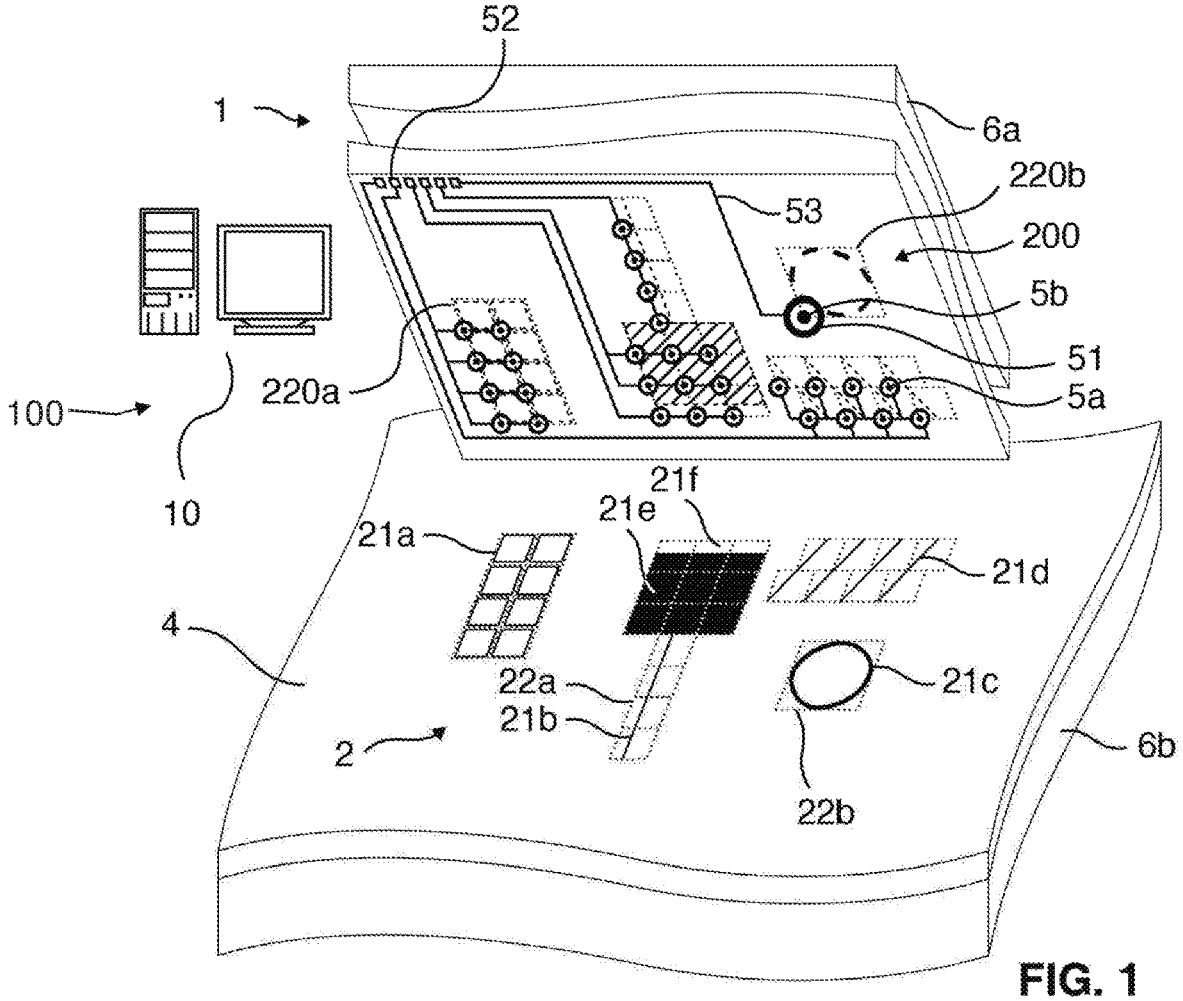
FIG. 1 shows a perspective view on a printing system with a print head according to a first embodiment and a substrate containing print patterns that were printed by said print head.

For overview purposes, the following definitions provide a listing of terms which are used to designate certain aspects of the printing system and of the printing method presented herein.

Print head: The print head according to the present invention contains at least ten nozzles at its bottom surface that are suitable for the electrohydrodynamic ejection of liquid. The nozzles are formed on the print head in specific arrangements that can be tailored to the requirements of a print pattern.

Active print head area: The active print head area is understood as the smallest rectangular area that can be defined to enclose all nozzles of the print head. The active print head area approximately reflects the area of the substrate that can be covered by a print head while simultaneously activating/deactivating printing from as many nozzles of the print head as possible.

Printing movement: Summarizes all relative movements between print head and substrate that are executed while activating/deactivating printing from the nozzles of the print head and that are executed in direct relation to such printing action (unless such movements specifically fall within the definition of a repositioning movement or a translation movement as defined below). The magnitude of the printing movement in a given direction is equivalent to the distance between the endpoints of a movement along said direction. For example, the magnitude of the printing movement in x direction will be 10 am (micrometer) if the print head moves with respect to the substrate by maximally 5 am (micrometer) in −x direction and by maximally 5 am (micrometer) in +x direction.

Reference position: The nozzles on the print head are formed with at least one reference position, preferably with exactly one reference position. The reference position indicates the initial placement and rotational arrangement of the print head with respect to an underlying substrate such that all nozzles are oriented with respect to the substrate in such a way that all nozzles of the same reference position can print nozzle-specific segments of the print pattern during a single printing movement. If the nozzles of a first reference position print material onto the substrate, these material deposits will be formed with respect to this first reference position. Hence, if nozzles of at least one further reference position will print onto the same substrate, the relative position between print head and substrate must first be shifted in order to place the nozzles assigned to the at least one further reference position above the initial placement of the pre-patterned substrate. Such a repositioning movement can be expressed by a vector that essentially defines the separation between the first and the at least one further reference position of the print head. The length of the vector is preferably smaller than the size of the active print head area in the respective direction.

Repositioning movement: A repositioning movement is defined as a quick, short-range movement that matches the relative position between print head and substrate to the requirements of a new reference position while all nozzles are deactivated. The required movement to switch between two reference positions is defined by the orientation and the length of the vector that is formed between these two reference positions. That is to say, that the repositioning movement relates to a movement within the same total print pattern.

Translation movement: The translation movement is defined as a quick, long-range movement that moves a print head and/or the substrate to a new position beyond the area segment of the substrate that has already been printed on by the print head, while all nozzles are deactivated. The translation movement is used to allow a print head to cover an area of the substrate that is considerably larger than the active print head area. The translation movement may be chosen approximately as large as the extent of the active print head area in order to print material right next to the just finalized total print pattern.

Global print pattern: The global print pattern is defined as a specific arrangement of printed material that covers at least parts of a substrate, the material of which can be deposited to the required locations and in the required amount by at least one print head. The global print pattern describes the desired final, i.e., the entire structure that has been created on the substrate after all involved print heads have finished their assigned printing jobs.

Total print pattern: The at least one total print pattern is defined as every part of the global print pattern (i.e. the material it is contained of) that is assigned to be printed by a given print head in between any two translation movements and before execution of the first translation movement, if a translation movement is required in the first place.

Print pattern: The print pattern is defined as the part of the at least one total print pattern (i.e. the material it is contained of) that is deposited by a print head during one printing movement that is not interrupted by a repositioning movement.

Primitive object/line: A primitive object (or primitive line) is understood as a line printed by a nozzle during a straight or a curved movement of the print head or the substrate, while the print head periodically ejects droplets. The length of the line depends on the magnitude of the movement of the print head or the substrate while the width of the line depends on the resolution properties of the ejecting nozzle. Preferably, the line has a width that is essentially equivalent to the diameter of a single ejected droplet. The limit of a line with essentially zero length is a dot. The dimensions of a dot in all direction are limited by the printing resolution. The thickness of a line can be adjusted by adjusting the movement velocity during printing or by printing at least one further line on top of the first line, i.e. by layering.

Primitive line layer: The primitive line layer is defined as the thickness of a primitive line that is added to said primitive line every time a nozzle passes along the primitive line and adds material to it.

Minimum and maximum movement velocity: The minimum and maximum movement velocities indicate the range of velocities within which proper primitive lines can be printed. Above the maximum movement velocity, the employed frequency of liquid ejection is too low to still generate a continuous primitive line, whereas velocities below the minimum movement velocity generate tilted pillars on the substrate instead of primitive lines.

Full and half cycle: A half cycle is defined as that part of a printing movement that creates a single primitive line layer by moving the respective nozzle during printing from the starting point of the primitive line to the ending point of the primitive line. A full cycle is described as that part of a printing movement that creates two primitive line layers by moving the respective nozzle during printing from the starting point of the primitive line to the ending point of the primitive lines and again back to the starting point of the primitive lines, thereby creating a second primitive line layer onto the first primitive line layer. At the end of a full cycle the nozzle is back at the same position relative to the substrate as it was at the beginning of the full cycle.

Patch: A patch is defined as any complex two-dimensional object that a print pattern is made of. A patch is formed of at least two parallel primitive lines, wherein all neighboring lines of these at least two parallel primitive lines are located at a distance from each other that is smaller than the width of an individual primitive line, such that the lines are partially printed on top of each other. The extent of the patch thereby becomes identical to the accumulated width of all parallel, partially overlapped primitive lines.

(First) Extraction electrode: An extraction electrode is associated with each nozzle on the print head. If a sufficiently high voltage is applied to the extraction electrode associated with a respective ink-containing nozzle, said ink will start to be ejected onto the substrate. Second extraction electrode: A second extraction electrode can be associated with selected nozzles. The first and second extraction electrodes are preferably formed such that droplet ejection is caused at a lower voltage if both extraction electrodes are supplied with said voltage compared to only supplying one extraction electrode with said voltage, while the other extraction electrode is at the same electric potential as the nozzle-contained ink.

Control level: The control level differentiates between the triggering sequences being supplied to a first and a second extraction electrode, wherein there is defined a higher and a lower control level, the higher control level relating to the triggering sequence that results in a lower frequency of activation/deactivation of the respective extraction electrode than the other triggering sequence.

Triggering sequence: A triggering sequence defines the periods of activation/deactivation of droplet ejection from a nozzle during a printing movement. Periods of droplet ejection are thereby caused by supplying sufficiently high voltages to the respective extraction electrodes at the required time intervals.

Contact point: A contact point is formed on the print head that can feed a triggering sequence to the extraction electrode of at least one nozzle by means of a conductive track. Every contact point can supply an individual triggering sequence, wherein all nozzles associated with the same contact point print with the same triggering sequence. This means that during a printing movement all these nozzles will eject liquid at the very same moments in time.

Individual print pattern: The individual print pattern describes all the parts, i.e., the primitive objects, of the print pattern that are printed by a given nozzle.

Individual printing movement: The individual printing movement describes all the required printing movements that a given nozzle must perform in order to create its individual print pattern. All nozzles that are operated with an identical individual printing movement are preferably associated with the same voltage lead.

Projected print pattern: The projected print pattern is understood as a dimensional accurate reproduction of the print pattern that is projected onto the print head surface. The projected print pattern has no physical appearance but can guide as means for deciding on the design of the print head, particularly on the placement of nozzles on said print head. The projected print pattern can already be realized in the design phase, when the print head is optimized by means of a computer software, wherein the projected print pattern can be drawn as a background layer that, for example, and enables the positioning of nozzles in direct relation to the individual print pattern it is later supposed to form on the substrate. For simplicity, it is understood in the following that any statements that are based on the geometry and orientation of the print pattern can also be based on the geometry and orientation of the projected print pattern, which is generally more useful, as the projected print pattern guides as design template for the print head.

Unit cell: A unit cell is a fictitious geometrical unit used to indicate what part of a print pattern is printed by a specific nozzle of the print head. Each unit cell is associated with exactly one nozzle and defines a boundary around an area segment of the print pattern that can contain at least one primitive object that is assigned to said associated nozzle. It is understood that the at least one primitive object assigned to a particular nozzle can be printed by said nozzle, and wherein a print pattern can be formed if every nozzle only prints the primitive objects that are assigned to it within the boundary of the at least one unit cell the nozzle is associated with. Through its boundary the unit cell reflects preferable printing movements of the specific nozzle of the print head when printing the primitive objects of a print pattern segment, wherein each primitive object is associated with exactly one unit cell of the at least one unit cell that is itself associated with the said print pattern segment. The maximum printing movement that is required to form the primitive objects associated with a given unit cell can be expressed by the size of a second, inner boundary of the unit cell. The inner boundary preferably has a distance from the outer unit cell boundary of 0 times to 0.5 times the width of the primitive objects, preferably of 0.25 times the width of the primitive objects that can be printed by the respective nozzle. The number of unit cells corresponds to a number that is equal or higher than the number of all nozzles on the print head, wherein every nozzle must be associated with at least one unit cell and wherein unit cells are formed such that every primitive object of the print pattern is enclosed by at least one unit cell. Unit cells are defined as a rectangular area for which a primary and a secondary orientation is defined. It is thereby preferable that primitive lines are always printed such that they are aligned with the orientation set forth by the primary orientation of the respective unit cell. As it is the case with the projected print pattern, the unit cells have no physical appearance but are used for design purposes only.

Print pattern segment: The print pattern segment is defined as all the primitive objects of a print pattern that are assigned to a nozzle through its association with at least one unit cell. If a nozzle is not involved in redundant overprinting, then the print pattern segment is identical to the individual print pattern of this nozzle.

Critical print pattern segment: The critical print pattern segment is defined as the at least one print pattern segment belonging to a total print pattern that defines the duration of finalizing said total print pattern. Infinitesimally reducing the duration for printing the at least one critical print pattern segment reduces the duration for finalizing the total print pattern, wherein a reduction of the duration for printing a non-critical print pattern segment does not directly result in a reduction of the duration for finalizing the total print pattern.

Reference nozzle position: The reference nozzle position is the preferable location of where a nozzle is to be formed on the print head surface. The reference nozzle position is preferably identified on the basis of the at least one unit cell that is associated with the nozzle, wherein the nozzle is formed at the boundary or within the boundary of said at least one unit cell.

Shifting movement: The shifting movement is part of a printing movement but is executed before initiation of printing, i.e. while all nozzles are deactivated. The shifting movement is performed along the primary and/or secondary unit cell orientation in counter-direction to the subsequent initial movement when printing is initiated. Its magnitude depends on the size of the unit cell along the respective unit cell orientation. Shifting movements are executed in connection to redundant overprinting.

Main corner: A main corner is defined for every unit cell and is the preferable reference nozzle position in case the primitive objects within said unit cell are being printed without a shifting movement.

Initial movement direction: The initial movement direction defines how a nozzle is preferably moved relative to the substrate along the primary and secondary unit cell orientation, respectively, when printing the first primitive line layer of any of the primitive lines that are associated with the same unit cell. The initial movement direction in the primary and secondary unit cell orientation is thereby preferably in the direction of the main corner towards the opposite corner along the primary unit cell edge and in the direction of the main corner towards the opposite corner along the secondary unit cell edge, respectively.

Nozzle row: A nozzle row includes at least two nozzles that are formed on the print head along a straight line, the straight line being identical in its orientation to the primary orientation of at least one unit cell of each nozzle contained in the nozzle row. Preferably, all nozzles of the nozzle row are separated from each other by the same distance. The nozzle row can be regarded as the simplest configuration of at least two nozzles that unite their individual print patterns into a larger entity. In detail, the at least two nozzles of the nozzle row are simultaneously activated while there is executed a printing movement along the orientation of the nozzle row. The primitive line segments created by each nozzle during the printing movement eventually overlap and form a common primitive line once the printing movement becomes equivalent in magnitude to the length of the (inner) unit cell along its primary orientation. For each nozzle row there is defined a leading and terminal nozzle, which are defined as the two last nozzles on the two endings of each nozzle row, wherein the leading nozzle is the one that is at the end of the nozzle row along the initial movement direction in primary unit cell orientation.

Nozzle array: A nozzle array includes at least two nozzles that are oriented along the secondary unit cell orientation, or it includes at least two nozzle rows or one nozzle row and one single nozzle that are oriented along the secondary unit cell orientation. Preferably all nozzles of the nozzle array are separated from each other by the same distance along the secondary orientation of the respective unit cell. In the same way as a nozzle row creates lines by combining the output of at least two nozzles, a nozzle array creates a patch by combining the output of at least two nozzles along the secondary orientation of the respective unit cell. For each nozzle array there is defined at least one leading array nozzle and at least one terminal array nozzle, which are defined as the at least two nozzles that lack at least one neighboring nozzle of the same nozzle array along the secondary unit cell orientation, wherein the at least one leading array nozzle is the one that is at the end of the nozzle row along the initial movement direction in secondary unit cell orientation.

Redundant overprinting: Redundant overprinting refers to the printing of at least one primitive object by a nozzle that is not assigned to said at least one primitive object. Particularly, redundant overprinting can be performed during a printing movement that has a distance that is longer than the distance set forth by the inner boundary of the unit cell. Such a movement may be executed if differently sized unit cells are being employed, where the larger unit cells require for longer movement magnitudes than the smaller ones. Instead of deactivating the nozzle, once a printing movement goes beyond the length set forth by the unit cell, the nozzle may be used to create thickness to dedicated parts of the print pattern segment of a neighboring nozzle. Redundant overprinting is not a process that is necessarily required for printing a given print pattern because any print pattern segment can be printed solely be the use of its assigned nozzle. However, the selective use of redundant overprinting can facilitate a shorter printing time and a less error-prone operation. The use of redundant overprinting generally involves specific adjustments of the nozzle position on the print head and other design parameters of the print head, as well as for modifications on the printing movement, particularly it can become necessary to introduce a shifting movement to the printing movement. Whether a nozzle is going to be used for redundant overprinting must therefore be considered already as input during the print head design.

Supporting nozzle: A supporting nozzle is understood as a nozzle that is solely associated with empty unit cells, i.e. the supporting nozzle is not assigned to any primitive objects. By use of redundant overprinting, a supporting nozzle can employed for creating thickness to dedicated parts of the print pattern segment of a neighboring nozzle.

Unit line: A unit line describes a print pattern that contains a single primitive line, the primitive line being printed during a movement that exactly follows the edge of the respective unit cell that is oriented along the primary unit cell direction and that is in contact to the main corner of said unit cell.

Unit pixel: A unit pixel describes a patch that covers an area that exactly matches with the boundary set forth by the respective unit cell.

Patch layer: A patch layer is defined as the accumulate thickness of all primitive lines being associated with a given unit cell and that is printed by a nozzle whilst said nozzle is moved along the secondary unit cell orientation from one end of the inner unit cell boundary to the other end of the unit cell boundary.

Bitmap resolution: The bitmap resolution is defined by the separation between neighboring nozzles in a nozzle row or a nozzle array. In a preferable situation a print pattern can be realized by only printing unit pixels. In other words, the bitmap resolution can be defined as the resolution obtained when only unit pixels are printed. This strongly reduces the requirement for individual contact points/individual triggering sequences and in case all unit cells have the same size and orientation, a print pattern can even be realized by a single contact point that simultaneously feeds a common triggering sequence to the extraction electrodes of thousands or even millions of nozzles by means of conductive tracks. However, a print pattern that is formed in such a way cannot directly profit from the maximum printing resolution. Instead, the maximum resolution of the print pattern will depend on how close nozzles can be arranged next to each other. If nozzles are formed closer to each other, a print pattern can be formed by smaller unit pixels (which are present at a larger number though) and hence with a higher resolution.

In the following, a few general considerations on the electrohydrodynamic printing system will be given. The description of the preferred embodiments is provided at the end of these considerations.

A print head according to the present invention is tailored to at least one unique print pattern, the print pattern representing a desired arrangement of primitive objects to be printed onto a substrate, the substrate initially being positioned beneath the print head at a reference position. In relation to the present invention, primitive objects are understood as basic forms of material deposits that are printed onto the substrate by the individual nozzles of the disclosed print head, particularly they relate to straight or curved lines of material. The smallest rectangular area that can be defined to enclose all nozzles of the print head is understood as the active print head area. The print pattern is printed onto the substrate by use of the nozzles formed inside the active print head area, during a printing movement between print head and substrate that entails specific sequences of nozzle activation/deactivation commands, wherein the nozzles commanded according to the electrohydrodynamic ejection principle. Electrohydrodynamic ejection, and particular the method known as NanoDrip printing as disclosed in the patent application No. EP 15153061.5 can achieve printing resolutions better than 100 nm.

A maximum magnitude of the printing movement in a given direction is equivalent to the distance between the extremities of a movement along said direction, measured from the reference position, wherein said maximum magnitude of the printing movement in any direction is smaller than the respective extent of the active print head area, preferably it is at least ten times smaller than the active print head area, such that the print pattern will approximately cover an area equivalent of the substrate that is similar in size to the active print head area. Nozzles are distributed on the print head such that the print pattern can be realized on the substrate if every nozzle prints no more than one individual segment of said print pattern, the segment consisting of all or of selected primitive objects that are all separated from each other by a distance that is no longer than the magnitude of the printing movement in the respective direction. The relative position of the nozzles on the print head is therefore chosen in direction relation to the relative position of the respective print pattern segments inside the print pattern. Hence, the print pattern can be decomposed into individual print pattern segments, wherein each print pattern segment is assigned to a single nozzle, and wherein the print pattern can be realized if every nozzle only prints its assigned print pattern segment. A print head according to the present invention can be optimized for printing throughput while still providing extremely high printing resolution. In order to achieve maximum printing throughput, it is preferable that the area covered by a print pattern segment becomes as small as possible such that the print pattern can be decomposed into a largest possible number of print pattern segments that are printed by nozzles that are formed on the print head at a high density. In average, the size of the substrate area that is covered by a print pattern segment will correlate with the distance between two nozzles on the print head, such that a print pattern segment can be printed by performing printing movements that relate to the distance between two nozzles rather than to the size of the whole print pattern, as it is the case with prior art.

Due to the small required magnitude of the printing movements, the maximum velocity of said printing movement can be very small, enabling exact movement trajectories with nanometer accuracy while still providing quick realization of the print pattern due to the large number of nozzles which are prepositioned on the print head with respect to the location of their assigned print pattern segments.

The printing throughput of an ink-jet print head directly depends on the printing resolution it has to achieve because every droplet covers an every smaller area segment of the substrate when said droplet becomes smaller. Keeping up with printing throughput while increasing printing resolution therefore requires for print heads with a higher nozzle count. Prior art ink-jet print heads generally contain up to around 1000 nozzles and achieve a maximum printing resolution of about 30 am (micrometer). A print head according to the present invention achieves printing resolutions of better than 100 nm, at least 300 times better than the best conventional ink-jet printers. Because covered area scales with the square of the printing resolution, the herein disclosed print head according to the present example has to contain up to 90'000 times more nozzles than a conventional print head, 90 million in total. The production of such a high number of nozzles according to a disclosed nozzle design is standard procedure when employing up to date microfabrication techniques. What becomes essentially impossible, however, is the registration of every individual nozzle. In relation to the present invention, this restriction manifests in a limited number of contact points that are formed on the surface of the print head. Every contact point can be connected by a conductive track to the extraction electrode of at least one nozzle and can supply a unique triggering sequence. In order to control millions of nozzles by an order of 100 contact points, a print head according to the present invention makes use of the fact that highly-resolved print patterns generally consist of periodic arrangements of primitive objects. Nozzles are therefore distributed on the print head such that print pattern segments can be defined and assigned to said nozzles such that a sufficiently large number of nozzles can be operated with the same triggering sequences.

In line with the above, the present invention is understood to be most useful in connection with nozzles that allow a very high printing resolution, better than the printing resolution obtained with prior art ink-jet printers. Particularly, the present invention relates to printing resolutions that can be better than 10 am (micrometer). Because electrohydrodynamic printing allows printing resolutions that are at least five times better than the diameter of a particular nozzle, the present invention relates to nozzles being operated with an electrohydrodynamic ejection mechanism and that are smaller in their diameter than 50 am (micrometer).

In order to form its print pattern segment, every nozzle will require for an individual printing movement. The individual printing movement is understood as the most efficient printing movement that can be executed only to print the print pattern segment of a give nozzle, irrespective of the printing movements that are required to print the print pattern segment of other nozzles on the print head. During its individual printing movement the nozzle is being activated/deactivated by a triggering sequence. Any two nozzles that have defined identical individual printing movements and identical triggering sequences can hence be connected to the same contact point. In the most optimal situation this allows all nozzles to be associated with the same contact point, meaning that millions of nozzles can be controlled by a single triggering sequence.

A print head can also contain more than one print pattern that can profit from a self-alignment when being printed onto the substrate. For example, the print head may have to print two different materials to the same location of the substrate, but to print a second material, a second nozzle is required, being filled with different printing inks. Physically, the second nozzle cannot be formed at the same position of the print head, and instead of creating an own print head for this purpose, the second nozzle may instead be formed at a distance from where it is supposed to deposit material onto the substrate. Once the first nozzle has finished printing, the second nozzle can be moved with respect to the substrate to its intended position by a repositioning movement and subsequently initiate printing. Hereinafter, the second nozzle according to this example is said to belong to another reference position than the first nozzle. At least one nozzle on the print head is associated with a first reference position that indicates how a print head must be orientated and positioned with respect to a substrate such that the at least one nozzle of the first reference position is located at its intended position with respect to the attempted location of its assigned print pattern segment. At least one further reference position can be defined, wherein the nozzles being associated with said at least one further reference position are said to print a further print pattern. Nozzles that require for the same individual printing movements can only be connected to an identical contact point if they have identical reference positions. Each reference position is associated with an own printing movement, wherein it is first printed the first print pattern by the nozzles associated with said first print pattern, and in an optional sequence of further steps at least one repositioning movement is executed to correct the print head/substrate position to the requirement of the at least one further reference position, such that the nozzles assigned to the respective at least one further reference position can print their respective further print pattern during a further printing movement. All print patterns printed by the same print head during a sequence of repositioning movements belong to a common total print pattern that is printed by the print head at an almost identical position of the substrate. Hence, the repositioning movement is smaller in magnitude than the size of the active print head area in any direction, preferably it is at least ten times smaller than the size of the active print head area. The purpose of the repositioning step is adding further complexity to a total print pattern but not to extend the covered area of a substrate. Because all print patterns of the same total print pattern are printed by nozzles that are formed on the same print head by precise microfabrication techniques, there are no specific alignment procedures required for aligning the first print pattern with at least one further print pattern.

In case material has to be printed onto an area fraction of the substrate that is larger than the active print head area, the same print head can print at least one further total print pattern after performing a translational movement between print head and substrate that is identical or larger to the active print head area. For example, the translational movement can be exactly matched to the size of the active print head area along the respective direction such as to stitch at least one further total print pattern to a first total print pattern, similar to how a photolithography stepper exposes the total area of a wafer in several exposure steps. The first total print pattern and the optional at least one further total print pattern are said to belong to the same global print pattern. The global print pattern represents the final state of printed material on a substrate and it can also contain the at least one total print pattern of at least one further print head. The total print patterns of at least one further print head can be aligned to the at least one total print pattern of the first print head by alignment procedure, for example by optical alignment procedures.

All print pattern segments of a print pattern can be printed solely by their assigned nozzles and eventually be merged into the print pattern during a printing movement that involves a first sequence of relative movements between print head and substrate while activating/deactivating droplet ejection by at least one first triggering sequence from a first number of nozzles, and second, if the print pattern is not yet completed, by repeating the procedure of the first step with one or more further sequences of relative movements between print head and substrate while activating/deactivating droplet ejection by one or more further triggering sequences from one or more further numbers of nozzles, until all print pattern segments have been fully printed, resulting in completion of the print pattern.

Ejection of ink from a nozzle is stimulated electrohydrodynamically, preferably by an extraction electrode that is provided for every nozzle on the print head, more preferably by an extraction electrode that is formed as a ring electrode and that surrounds the nozzle, said extraction electrode being suitable for causing droplet ejection when being activated by a voltage that is applied to the extraction electrode relative to the printing ink contained inside the nozzle. As long as the voltage is kept being applied, the nozzle will continue to eject liquid at a constant average flow rate, making it simple to activate a large number of nozzles in parallel when supplying their extraction electrode with a common voltage signal.

For nozzles that are not activated, the printing ink and the extraction electrode should optimally stay at equipotential or at least at an electric potential difference that is insufficient for causing droplet ejection. The connection between the contact point and the extraction electrode is preferably realized by fine, electrically conductive tracks that are preferably formed on the print head on the same layer as the extraction electrode, preferably from an excellent metallic conductor such as gold, silver or copper, wherein the conductive tracks of nozzles that are to be connected to a common contact point can eventually be merged into a single conductive track before being contacted to the contact point.

In relation to the present invention a contact point is understood as a conductive patch that is subjected to a given voltage waveform and that is preferably formed outside the active print head area on the outer regions of the print head. The contact point can be associated with the output of a functional element that is situated on the print head or it can be connected to a functional element that is not situated on the print head and therefore is in contact to the print head via conductive wiring or the like. For example, said conductive wiring can be contacted to the contact point in the form of a flexible printed circuit board (FPCB) that is directly contacted to the front side of the print head, where the nozzles are situated. Conductive wiring can also be contacted to the backside of the print head if through-silicon vias are formed on the print head at the position of the contact points, the through-silicon vias transferring the voltage signal between back- and front side of the print head. Alternatively, certain functional elements, such as logic elements, can also be directly arranged on the front side or on the back side of the wafer, wherein functional elements situated on the back side can be contacted to the contact points by means of through-silicon vias. A functional element can be an electrical switch or it can be a voltage source or it can be any other electrical element that is appropriate for generating and/or distributing voltage waveforms. However, the maximum number of individual contact points is restricted by technical constraints such as the physical extent that is required for building and proper electrical insulation of any two contact points or by a bearable amount of data that can processed when controlling the supplied voltage waveforms of a number of contact points. While operation of the print head requires for at least one contact point to be situated on the print head, it is generally preferable that the number of contact points is at least 10, more preferable it is at least 100, but most preferably the number of contact points on the print head is 500 or more. A higher number of contact points can result in a compatibility of the print head with a larger number of unique print patterns because more nozzles can be individually controlled, allowing such individually controlled nozzles to print their print pattern segments independent from all other nozzles. Furthermore, a larger number of contact points can solely or in addition help reducing the duration for completion of a print pattern due to reasons to be outlined below.

When contacting contact points to the respective nozzles, conductive tracks originating from different contact points will have to be electrically insulated from each other while being routed along the print head surface. Electric insulation must also be guaranteed between any two extraction electrodes, in case that these are contacted to different contact points. In order to make contact between an extraction electrode and the respective contact points, conductive tracks may have to cross each other while keeping up electrical insulation between them. Electrical insulation may also be required between a conductive track and an extraction electrode, in case they are contacted to different contact points, particularly if such a conductive track is routed across the gap between two closely spaced nozzles (also referred to as internozzle gap). In the latter case, in order to provide closest possible separation between two neighboring nozzles, conductive tracks are preferably formed as narrow as possible by the capabilities of the chosen microfabrication techniques, at least in the region where the conductive track crosses the internozzle gap of two nozzles, but wherein conductive tracks must be formed with a width that is at least wide enough to bear the applied current load. Crossings between two conductive tracks to be electrically insulated from each other can be achieved by deposition of a patterned insulating strip onto one of the involved conductive tracks followed by the deposition of a thin metallic channel across said insulating strip. The metallic channel is used to make contact between two cleaved ends of the second conductive track. Hereby, the insulating strip must be sufficiently thick in order to prevent electrical breakdown between the bridging metal and the underlying conductive track, when applying the highest desired voltages between them. Preferably the insulating strip is extended into a global layer wherein only at the positions where the bridging metal has to make contact with ends of the conductive tracks, said insulating layer is opened and the bridging metal deposited and patterned in such a way that it conducts out of one hole into the other one.

The method of print head operation differentiates from prior art in that the print pattern can be functionally decomposed into a mix of vector graphic and bitmap graphic. The bitmap graphic is essentially composed of the arrangement of print pattern segments through the fixed position of nozzles on the print head, wherein each print pattern segment essentially corresponds to the pixel of a bitmap according to prior art. In comparison to the pixels of conventional bitmap graphics, print pattern segments according to the present invention are preferably not restricted to closely arranged, rectangular pixel matrices though. This is mainly due to the fact that generally large numbers of nozzles will not all be individually addressable due to the limited contact points available, and accordingly a fully digital operation of the print head is not possible under these circumstances. It is therefore preferable to define print pattern segments, and hence the position of nozzles on the print head, on the basis of equivalency in individual printing movements and triggering sequences, which is unlikely to be obtained by a purely rectangular matrix arrangement. As indicated before, two print pattern segments that can be printed by the same individual printing movement and the same triggering sequence can be printed by their assigned nozzles during the same movement sequence and can be associated with an identical contact point. Through the provided number of contact points, the print pattern created by the print head is essentially composed of an arrangement of print pattern segments with a restricted number of different appearances, as it is the case with a conventional bitmap graphic. Size and/or geometry of the print pattern segment is adjustable by the print head such that at least one further print pattern can be created by the same print head, with the restriction that print pattern segments are to be created in positional agreement with the location of their assigned nozzles. Importantly, not every print pattern segment can obtain such information individually but instead all print pattern segments assigned to the same contact points must obtain the same appearance which strongly restricts the design variability compared to a conventional bitmap graphic. However, while the pixels of a conventional bitmap graphic can generally only obtain a very limited number of different appearances, the content of the print pattern segment can represent a complex graphic on its own, that can have almost limitless appearances depending on how the print head is exactly operated. Even though a print head is generally optimized for printing a specific print pattern, the same print head can therefore be employed to print a large number of further print patterns as well.

The print pattern segment is preferably formed as a vector graphic being composed of primitive objects. These primitive objects are equivalent to basic geometries that are printed by a nozzle during a relative motion between print head and substrate while the nozzle is activated/deactivated by a triggering sequence. The disclosed invention particularly relates to nozzles that work according to the principle of electrohydrodynamics. Such nozzles are preferably formed in accordance with the nozzle geometries disclosed in patent application No. EP 15153061.5. Specifically, when employing the methods disclosed in EP 2 540 661 A1, upon application of a sufficiently high voltage, continuous ejection of ink from nozzles as those disclosed in patent application No. EP 15153061.5, can result in the formation of structures that are preferably formed with lateral dimensions being as small as the ejected liquid elements, e.g. the diameter of a spherical droplet. Continuous ejection of liquid to the same position of the substrate does thereby not necessarily result in liquid accumulation but instead in an initial dot that eventually starts growing as an out-of-plane pillar-like structure towards the nozzle, from the solid material contained in the ink. Slow relative movements between print head and substrate during printing can analogously be employed to form lines of densely arranged solid material contained in the ink, such lines preferably having a width that is essentially equivalent to the respective dimensions of the ejected liquid elements, e.g. to the diameter of a spherical droplet. While the print head is not restricted in its operation to these specific methodologies or to a specific nozzle design, it is preferable that the primitive objects used for the formation of complex structures are selected from printed lines, preferably straight lines, wherein printed dots can be seen as the limit of a line with zero length. As will be disclosed in more detail below, such printed objects can be arranged and combined into two-dimensional shapes, the geometry of which only depends on the printing movement and on the chosen triggering sequence along the course of said movement. Because the triggering sequence as well as the printing movement can be freely varied during printing, the content of a print pattern segment can be freely varied as well. Again, nozzles associated with identical contact points have to print during the same individual printing movement and with the same triggering sequence and hence they are assumed to print the same print pattern segment. However, as disclosed in patent application No. EP 15153061.5, preferable nozzle embodiments that are incorporated in a print head according to the present invention can be formed with different diameter and with different actuation characteristics. This means that any two nozzles being connected to the same contact points can eject droplets of different diameter and/or they can eject such droplets with a different frequency. Hence, the primitive objects created by any two nozzles can be different, and therefore two nozzles being bound to a common individual printing movement and to a common triggering sequence may still print different print pattern segments, at least to the point at which such differences can be effected by the different appearance of their respective primitive objects.

In order to generate lines of different width one can adjust the droplet diameter, for example. The droplet diameter on the other hand can be influenced by the initial choice of the nozzle diameter, wherein larger nozzles provide larger droplets. In situ control of the droplet diameter can be achieved by adjustments in the electric field at the nozzle though changes of the voltage that is applied between the extraction electrode and the printing ink (i.e. the nozzle) and/or it can be achieved by mechanically adjusting the static pressure of the nozzle-situated liquid with respect to the gaseous environment of the print head. The latter is preferably performed with a pumping unit as disclosed in patent application No. EP 15153061.5. Preferably, such a pumping unit allows the creation of at least two pressure states, the pressure states of which can be used to supply at least two groups of nozzles with ink of different pressure. Instead of adjusting the ejection voltage, the electric field at the nozzle can also be adjusted by different implementations of the geometrical properties of the extraction electrode and other electrodes that have an influence on the electric field at a nozzle. Two nozzles of identical diameter but different electrode implementation can therefore be employed to print differently wide lines, also when being operated by the same voltage. Such adjustments on the nozzle geometry and the like can of course not be performed in situ but must be predefined for every print head. It is understood that the disclosed invention is not only compatible to the specific process solutions disclosed in EP 2 540 661 A1. A print head according to the present invention may also be operated with nozzles that are operated in the so-called cone-jet mode, for example. In the cone-jet mode, liquid is not ejected in the form of droplets but as a continuous jet, wherein control of deposited liquid may be obtained by limiting the duty cycle of liquid ejection. Also, it is not a necessary requirement that a primitive line obtains the width of a single droplet. Instead, the line may be allowed to grow in width by excessive liquid deposition, wherein the width of the line can be controlled by the average volumetric ejection flow rate of liquid or by a movement velocity.

Assuming a fix number of available contact points, the disclosed considerations for forming a print head are majorly targeted at optimizing the throughput at which a print pattern can be printed. Throughput is generally opposed, however, by the variability of a given print head, meaning that a print head can generally be made more flexible in printing different print patterns when giving up on throughput. For example, some areas of the print pattern that require for large variability can be equipped with nozzles that employ more individual contact points than the nozzles of other regions. Equipping a number of nozzles with a larger number of contact points makes those nozzles less dependent on each other. It is therefore understood that a print head can be formed at the particular requirements of the user.

In order to relate a print pattern to a print head, it can be useful to define a projected print pattern. The projected print pattern is understood as a dimensional accurate reproduction of the print pattern that is projected onto the print head surface. The projected print pattern has no physical appearance but can guide as means for deciding on the design of the print head, particularly on the placement of nozzles on said print head. The projected print pattern can already be realized in the design phase, when the print head is optimized by means of a computer software, wherein the projected print pattern can be drawn as a background layer that, for example, enables the positioning of nozzles in direct relation to the individual print pattern it is later supposed to form on the substrate. For simplicity, it is understood in the following that any statements that are based on the geometry and orientation of the print pattern can also be based on the geometry and orientation of the projected print pattern, which is generally more useful, as the projected print pattern guides as design template for the print head. The orientation and position at which the print pattern is projected onto the print head will determine how the print pattern is eventually printed onto the substrate with respect to the orientation and position of the print head said print pattern is printed with. Given the projection of the print pattern on the print head, the formation and modification of print pattern segments, of nozzles and of the assignment of said nozzles to the provided contact points is a process taking place simultaneously. In order to relate the location of a nozzle to an associated print pattern segment it is useful to define at least one unit cell for each print pattern segment. The consolidated boundaries of the at least one unit cell are identical to a boundary of the projected print pattern segment that the at least one unit cell is associated to. Like the projected print pattern, the unit cells have no physical appearance on the final print head but during the process of designing the print head, their defined form and position guides not only as auxiliary means for the eventual position of nozzles on the print head but also for the choice of appropriate triggering sequences and printing movements executed between print head and substrate during printing of the respective print pattern segments. The unit cells are defined as rectangular shapes, wherein the two main axes of the rectangular unit cell identifies the two preferred movement directions that are executed between print head and substrate during printing. Before the print head is manufactured it is preferable that the layout of print pattern segments and unit cells is simultaneously optimized with the arrangement and size of nozzles, the assignment of these nozzles to contact points and their interconnection by conductive tracks. Preferably said optimization process is supported by the use of computer-aided design (CAD) software or other software that allows the creation of design files for microscopic fabrication techniques. Most preferably, said software can be adapted by routines that are dedicated on optimizing the final print head layout on the basis of specific user requirements, for example the optimization of printing throughput.

The nozzle that is assigned to a print pattern segment is preferably positioned at the boundary or within the boundary of the at least one unit cell that is associated to said print pattern segment. The preferable location of the nozzle in its at least one unit cell depends on the actual printing movements. Preferably, the nozzle is arranged at one of the corners of the unit cell. Any initial movement between print head and substrate is then preferably performed such that the nozzle is being moved in direction of the quadrant that is laid out by the two edges of the rectangular unit cell that have their common origin at the corner where the nozzle is located. Assuming the initial position of the print head with regard to the substrate, said initial movement direction provides a means for transferring the print pattern segments onto the substrate in positional and rotational agreement with how the nozzles were designed with respect to the projected print pattern. The initial position between print head and substrate before printing initiation is equivalent to the reference position of all nozzles that are involved in printing the same print pattern. If at least one further print pattern is printed by the print head, a repositioning movement will be necessary in order to swap between the at least two reference positions.

Preferably, the unit cell is defined with an additional inner boundary that is separated from the initial, outer boundary by a certain distance, i.e. which forms a rectangular area within the initially defined, outer unit cell. While the outer boundary of the unit cell is defined to enclose all associated primitive objects, the inner unit cell boundary guides as means for defining the maximal magnitude of the printing movement in any direction that is required to form said primitive objects being associated with the unit cell. As stated before, every primitive object has an own extent, i.e. a line is not formed with zero width but with a finite width that depends on the nozzle design and the actuation characteristics of said nozzle. Hence, if a structure is formed from primitive objects of given width, the required maximum translations of the printing movements will be shorter than the maximum translations required for an identical structure that is formed from comparably narrower primitive objects. The size of the inner unit cell boundary is therefore an indication for the individual printing movement of a nozzle. If an isolated nozzle is used to print an isolated print pattern segment that is not in direct contact to the print pattern segment of any other nozzle, said isolated nozzle is preferably defined with an inner unit cell that has all its edges separated from the outer unit cell by a distance that is equal to half the width of the primitive lines printed by the isolated nozzle. In the following, every time it is defined a movement command between print head and substrate in relation to the dimensions of the unit cells, it is therefore understood that such reference is made to the inner unit cell boundary.

Nozzles printing at the same time preferably have unit cells of identical orientation, wherein the nozzles associated with unit cells of equivalent orientation are preferably positioned at the same location with respect to the unit cells they are associated to, such that all of said nozzles can be operated during the same printing movement in parallel. Hereinafter, the position that complies with these requirement will be referred to as the reference nozzle position. A preferable reference nozzle position can be a corner of the respective inner unit cell, wherein simultaneous use of the nozzles of several unit cells implies that the chosen corner is preferably identical with respect to the common orientation of all simultaneously operated unit cells, making said corner of the inner unit cell the main corner of the unit cell. In case more than one unit cell is defined for a given print pattern segment, it is preferable that these at least two units cells associated to the respective nozzle are defined such that a nozzle position on the print head can be defined that is identical to the preferred reference nozzle position of all of said at least two unit cells. As will be explained below, the preferable nozzle position can also be different from the main corner. In the following the preferable arrangements of nozzles on the print head are occasionally defined through considerations of the position, orientation and shape of the unit cells as they are defined on the print head, wherein the positioning of nozzles with respect to these unit cells can be understood on the basis of global considerations disclosed throughout this document. As will be shown in the following the choice of the position of the nozzle on the print head depends on specific operational execution of a print head, which is why an expert will appreciate that print head operation is principally represented by the choice of the unit cells, which are considered in parallel with the formation and modification of nozzles on the print head. It is further understood that the unit cell refers to the absolute lateral nozzle position for the case the print head is at its reference position with respect to the substrate.

The movement velocity during printing is preferably chosen between 1 am/s (micrometer per second) and 10 mm/s, more preferably between 10 am/s (micrometer per second) and 1 mm/s in order to allow high printing accuracy. Due to the small size of ejected droplets the preferable velocity is generally much slower than that of prior art ink jet printers. In order to closely arrange droplets into a line, a maximum movement velocity must not be exceeded. The maximum movement velocity is calculated by multiplying the droplet diameter with the smallest frequency of droplet ejection, wherein it is preferable to choose the movement velocity lower than half the maximum movement velocity such as to produce lines from strongly overlapping droplets, generally resulting in better line homogeneity. At half the maximum movement velocity just two droplets will be overlapped at any portion of a printed line. A higher degree of droplet overlapping during line formation can be obtained by further decreasing the movement velocity, thereby enabling a change in line thickness while printing a primitive line. Depending on the employed ink and printing conditions, overlapping many droplets during a continuous movement will preferably result in out-of-plane growth of a printed line with only marginal increase of the line width. On the other hand, decreasing the movement velocity below a minimum movement velocity can result in the formation of a tilted pillar as disclosed in EP 2 540 661 A1, generally once the line obtains a thickness-to-width aspect ratio of above one. When attempting to print lines that are in contact to the substrate such formation of tilted pillars is circumvented by preferably employing movement velocities that are larger than the minimum movement velocity. If a desired line thickness should obtain an aspect ratio of above one, such lines can be obtained without creating tilted pillars by overprinting an already printed line with at least one further line.

Importantly, any two nozzles having different diameter will generally have different minimum and maximum velocities. In fact, when ejecting droplets at the same frequency, a first nozzle that is X times larger than a second nozzle, will generally eject droplets that are about X times larger than the droplets ejected by the second nozzle if the pressure in the fluid reservoirs is the same. At the same movement velocity, droplets of the first nozzle will therefore overlap X times more often than the droplets ejected by the second nozzle. Hence, if two nozzles of different diameter are simultaneously printed with during a common movement, then the minimum movement velocity is preferably chosen on the basis of the large nozzle, while the maximum movement velocity is preferably chosen on the basis of the comparably smaller nozzle. Because the minimum movement velocity depends on the printed line thickness, it will also depend on the solid material loading fraction inside the printing ink. In case that two differently sized nozzles cannot be printed with in parallel because the maximum movement velocity becomes equal or smaller than the minimum movement velocity, then the minimum movement velocity may be reduced by reducing the solid material loading fraction inside the printing ink.

On the print head at least two nozzles may be closely arranged in a nozzle row, preferably said nozzles being assigned to rectangular unit cells of identical size, such that two neighboring unit cells can be connected by overlapping the two facing edges of their outer unit cell boundary. The unit cells preferably define a primary and a secondary orientation that are oriented along the two main edge orientations, the primary orientation being parallel to the alignment direction of the nozzles in the nozzle row and the secondary orientation being parallel to the edges of the rectangular unit cell that are perpendicular to the primary unit cell orientation. The nozzle rows can be formed in order to print at least one primitive line that extends beyond the boundary of the outer unit cell boundary of a unit cell along its primary orientation and that may have a length that is longer than said unit cell along the primary orientation (hereinafter referred to as "primary unit cell length") of its outer boundary. The alignment direction of the unit cells that are part of the nozzle row is preferably chosen identical to the required orientation of the primitive line, wherein the unit cells are preferably placed such that the position of every nozzle of the nozzle row is incident with a point of the line as it is projected onto the print head by the projected print pattern, and wherein the main corner of one of the unit cells of said nozzle row preferably intersects with one of the two endings of the line. It should be noted that the size of the unit cell along the secondary orientation (hereinafter referred to as "secondary unit cell length") of its outer boundary generally has no methodological use if the associated print pattern segment solely consist of a single line being formed along the primary unit cell orientation. In such a situation it is preferable though to form the unit cell as a square, the extent of which will give an impression of how much physical footprint of the nozzle on the print head.

A primitive line that is longer than the primary unit cell length or that only crosses the boundary between the unit cells of two neighboring nozzles can be printed from a nozzle row by combining the printing output of all nozzles contained in said nozzle row. Any two parts of the line that is situated in the respective unit cells can be printed by the respective nozzle associated with said unit cell and be interconnected at the common boundary of the two neighboring unit cells. Preferably, so-printed primitive lines and/or the respective unit cell are defined such that the lines obtain a length being equivalent to an integer value of the primary unit cell length. In this case the individual line segment to be printed by any of the respective nozzles will be of a common length. Creating and interconnecting such preferable line segments can be achieved by printing from all required nozzles simultaneously, i.e. by a common triggering sequence, while performing a relative print head/substrate movement along the common alignment direction by a distance that matches the primary unit cell length of the inner unit cell boundary, wherein eventually the simultaneously printed line segments make contact and overlap with each other, thereby creating a long line from several equally long line segments. A connection between the primitive line segments printed by the nozzles of two neighboring unit cells can only be obtained if the distance between the inner and outer unit cell boundaries along the primary unit cell orientation is smaller by less than half the primitive line width. Preferably, said distance is chosen identical for the two neighboring unit cells, and by doing so the two nozzles associated with the neighboring unit cells will exchange an identical amount of material that is being printed onto the respective neighboring primitive line segment in order to eventually form a connection between those primitive line segments. It is understood that the exchange of material between the print pattern segments assigned to two neighboring nozzles for the purpose of forming a connection does not challenge the circumference of the respective print pattern segments (i.e. the combined boundary of the at least one outer unit) and the primitive elements it contains.

The connection of primitive line segments results in overlapping regions that can be different in height than the rest of the line, primarily due to the own width of the line and its rounded line endings that start overlapping when two line segments are printed on top of each other. The height inconsistency can be reduced by preferably choosing the distance between inner and outer unit cell boundary along the primary unit cell orientation at 0.2-0.4 times the width of the primitive line. In order to enable a proper interconnect between two overlapping line segments, the movement direction between print head and substrate must be exactly matched to the alignment direction of the nozzles. When printing at least one primitive line by several nozzles being part of a nozzle row it is preferable to choose the primary unit cell length according to considerations that allow a maximization of the printing throughput. Unless it is attempted to locally reduce printing throughput it is preferable that the primary unit cell length is not chosen larger than the smallest possible distance that two nozzles can be separated at along the primary unit cell orientation, such that the printing of the primitive line can be performed by a maximum number of nozzles.

Combining several nozzles to jointly print a long primitive line is only possible if the primitive line to be printed is made of line segments that can be connected at the overlapping edge between two unit cells. In case that nozzles are properly aligned along the primary orientation of the nozzle row, the two endings of a line segment on either side of the overlapping edge of two neighboring unit cells must be at the same absolute position along the secondary unit cell orientation, at least at said overlapping edge. The line segments may follow curved and otherwise arbitrary movements within the interior of the unit cells, but eventually, when being overlapped, neighboring line segments have to be guided to their intended connection point at the overlapping edge of their unit cells. Hence it is not possible to jointly form primitive lines by several nozzles, if such lines have a non-linear long-range appearance, non-linear meaning that the connection points between neighboring unit cells along a nozzle row cannot be fitted with a straight line.

Preferably, movements during printing are executed by a piezoelectric positioner that supports movements in at least two dimensions, preferably in three dimensions. Piezoelectric positioners provide the ultra-high accuracy that is required for even highest resolution printing but only provide limited movement magnitudes. Because the relative movement between print head and substrate is of small magnitude during printing, as it relates to the size of a print pattern segment and not to the size of the whole print pattern, a short-range but high-precision piezoelectric positioner is appropriate during printing, in contrast to prior art. This short-range, high-precision positioning device can be coupled with at least one further positioning device, preferably one that allows for longer-range movements, but for which lower precision can be tolerated. During a printing movement, the substrate can fixed while the print head is moved by the high-precision positioning device, wherein the substrate can be associated with a long-range positioning device that allows the quick placement of the substrate beneath the print head or the execution of other movement commands that require for longer-range movements, particularly of a translational movement. It is understood that "positioning device" in the following globally refers to all possible combinations of arranging positional sub-devices that are associated with either the print head or the substrate.

For example, a positioning device may also consist of a single positioner that combines both, short-range or long-range movements. Such a solution can be a good compromise between precision and long-range motion. A preferable further capability of the positioning device is the facilitation of rotational movements between print head and substrate such that a precise rotational alignment can be achieved between print head and substrate, a capability that is most useful when the print pattern is printed onto a substrate that already contains structural elements to which the print head has to be aligned to. Another preferable capability of the positioning device is the facilitation of tip/tilt movements to be applied between print head and substrate, preferably by tilting or tipping the print head with respect to the substrate, such as to align the print head with the horizontal plane of the substrate.

Primitive lines of different orientation can be printed by creating unit cells that fit in their primary orientation with the orientation of the respective primitive line. However, primitive lines of different orientation cannot be printed simultaneously during the same movement. Instead, primitive lines with at least two different orientations must be printed sequentially by preferably first printing all primitive lines of a first orientation, and second by printing all primitive lines of a second orientation, and third by repeating this procedure for the lines of any further orientation. A nozzle can thereby operate with more than one unit cell orientation (i.e. it can print primitive lines of different orientation), for example in case that the print pattern segment assigned to said nozzle contains two intersecting lines forming an intersecting angle. To comply with at least two orientations of primitive lines, the respective print pattern segment can be defined by at least two unit cells, wherein the at least two unit cells preferably have a common main corner, such that one nozzle location satisfies the preferable location of both of the at least two unit cells.

Nozzles and nozzle rows can be created wherever a primitive line is required. In case that at least two parallel primitive lines have to be formed on the substrate with some separation, preferably at least two separated nozzles or two parallel nozzle rows are formed to simultaneously print the at least two parallel lines. The minimum separation between any two nozzle rows and any two nozzles in general depends on the space taken up by the nozzle, its associated electrodes and any further separation required between those electrodes along the secondary unit cell orientation. The distance between two parallel nozzle rows must comply with this minimum separation requirements as well and hence two parallel lines can only be simultaneously printed by two separate nozzles or nozzle rows, if the separation between the lines is equal or larger compared to the smallest possible separation between two nozzles along the secondary unit cell orientation. If the required line separation is smaller than this value, both primitive lines can be printed by the same nozzle or nozzle row sequentially, wherein the nozzle or nozzle row, after conclusion of the first primitive line, is moved along the secondary unit cell orientation by a distance that is required to place the nozzle above the intended position of the second primitive line, upon which the second primitive line can be printed by performing the movement along the primary unit cell orientation. Preferably, movements during which all nozzles of the print head are deactivated and which have to sole purpose of moving the nozzles of the print head to a new position, are performed with a high acceleration and with a high velocity that can be substantially higher than the maximum printing velocity. This also includes repositioning and translational movements.

The duration for printing one layer of a primitive line is given by the length of the primitive line divided by the chosen movement velocity. If the primitive line is printed by a nozzle row, the duration for printing the primitive line is given by the longest duration for individually printing any of the segments the primitive lines is made of (i.e. the part of the primitive lines that is assigned to a single nozzle). The line thickness (i.e. the out-of-plane thickness) can mainly be adjusted by the choice of movement velocity and/or the amount of overprinting (see below) and/or by changing the ejection characteristics, the latter of which generally also affects the droplet diameter though. A primitive line can be overprinted with at least one further primitive line layer by at least once revoking the movement that was executed to print the previous layer of the primitive line, while continuing to eject material onto the primitive line. This forward-backward cycles can be continued until a line obtains the desired thickness. In the following, a single forward-backward cycle will be referred to as full cycle wherein a single movement in either direction will be referred to as a half-cycle. It should be noted that the word "forward" is used in order to describe the initial movement direction of the nozzle to print the first layer of a primitive line.

If a structure needs to be wider along the secondary unit cell orientation than the largest applicable width of a primitive line, such features can be created as a composite of at least two primitive lines that are preferably overlapped along the secondary unit cell orientation. In the following any structure that is made of at least two primitive lines that are overlapped with an offset along the secondary unit cell orientation will be referred to as a patch. Preferably, patches are created in a first step by forming a first primitive line along the primary unit cell orientation, in a second step by offsetting the relative print head/substrate position along the secondary unit cell orientation by a distance that is smaller than the width of the first primitive line, and in a third step by creating a second primitive lines at the new offset position, said second primitive lines thereby overlapping with the first primitive line and creating a patch. Further widening of the patch can be achieved by continuing the procedure with the attachment and overlapping of a further number of primitive lines along the secondary unit cell orientation. A continuous patch can be extended by the addition of further primitive lines until the accumulated offset distance along the secondary unit cell orientation is identical to the secondary unit cell length. The resulting patch from such an accumulated offset distance that matches the secondary unit cell length can be identical in its area to the unit cell area, in case that the length of every primitive line also matches with the primary unit cell length of the outer unit cell boundary, wherein such a patch is referred to as a unit pixel. A unit pixel can be regarded as the closest resemblance of a pixel in a conventional bitmap graphic.

A patch can be extended beyond the circumference of the unit cell along its secondary unit cell orientation by combining the patches that are printed by two nozzles being part of a nozzle array. The nozzle array is formed by closely arranging at least two nozzles, preferably of the same alignment direction, along the secondary unit cell orientation. Preferably, these nozzles are contained in unit cells of the same size, wherein two neighboring nozzles are formed such that the edges of their facing outer unit cell boundaries are exactly matched. In order to extend the patch of two neighboring unit cells along the secondary unit cell orientation, the distance between the inner and outer unit cell boundaries along the secondary unit cell orientation must be chosen smaller than half the width of the primitive lines. Preferably, the distance is chosen identical for the unit cells of both neighboring nozzles, wherein the formation of a line at the position of the respective inner boundary of each unit cell will lead every of the two nozzles to add an equal amount of material to the primitive line segment of the respective neighboring nozzle. The lines are thereby contacted to each other and form a patch that extends across the overlapping edge of their common outer unit cell boundaries. If every nozzle of the nozzle array prints a unit pixel, the resulting length of the patch along the secondary unit cell orientation will be equal to the number of aligned nozzles times the common secondary unit cell length of the outer boundary of their associated unit cells. However, the total accumulated offset distance along the secondary unit cell length is equal to only one time the secondary unit cell length of the inner unit cell boundary. Topographical inhomogeneities at the overlapping edge between two neighboring nozzles can be reduced to essentially zero by choosing the distance between inner and outer unit cell boundary along the secondary unit cell orientation exactly half as large as the offset distance between any two primitive lines that the rest of the patch is made of.

Any of the at least two nozzles that are aligned along the secondary unit cell orientation can be part of a nozzle row that extends in either direction of the primary unit cell orientation. Such extension of the nozzle array along the primary unit cell orientation allows a patch to not only grow beyond the circumference of the unit cell along its secondary orientation but also along its primary orientation by overlapping the endings of all primitive line segments also along the primary unit cell orientation, as described above.

In order to reduce the complexity of the actuation electronics, it is preferable that the number of unique combinations of individual printing movements and triggering sequences is minimized. Particularly, this can be achieved by decomposing a print pattern into print pattern segments that entail a maximum number of unit pixels. In case a print pattern is fully decomposed into unit pixels of equal size, said print pattern can potentially be printed by use of a single contact point. Doing so, the resolution of any two-dimensional structure will be inherently limited by the size of the smallest unit cells that are being employed on the print head. The unit cell size of any nozzle can essentially be chosen as small as required by the respective print pattern segment. However, if nozzles are arranged in nozzle rows or nozzle arrays such as to jointly print a large structure, the minimum unit cell dimensions become dependent on the distance by which these nozzles can be separated from each other. Hence, the smallest possible size of closely-arranged unit cells is defined by the minimum separation distance between the employed nozzles along the primary and secondary unit cell orientation, respectively. Because the minimum separation distance depends on the nozzle diameter, the use of smaller nozzles generally also makes possible a reduction in unit cell size. For example, employing a nozzle diameter of 1 μm (micrometer), a unit cell with a size of 5 μm (micrometer) may be formed, in which case the sole use of unit pixels restricts the resolution of the print pattern to 5 μm (micrometer). In comparison, the use of a nozzle having a diameter of 5 μm (micrometer) will require for a unit cell that is substantially larger than 5 μm (micrometer), potentially by about the same factor as the difference in nozzle size. The maximum resolution that can be obtained from a print head when building a print pattern solely on the basis of unit pixels can still be better than the resolution obtained with prior art ink-jet printers, which is generally restricted to about 30 μm (micrometer). Furthermore, due to the fact that the printing resolution of the disclosed print head is much better than the resolution provided by the unit pixels, every unit pixel can be formed with highest accuracy, i.e. with a well-defined size and geometry and edge roughness in the nanometer regime. Such quality parameters are of great importance for functional material printing and are often not sufficiently mastered with prior art ink-jet printers, where lines roughness and topological inhomogeneity are a result of the smallest pixel being a single droplet instead of a matrix of many extremely small droplets, as it is the case for the present invention. The extreme control of size and geometry of a unit pixel further allows two neighboring unit pixels to be arranged next to each other with well-defined gaps, the gaps of which can be as narrow as the width of a primitive line. In context of the disclosed invention, resolution is defined by to major properties. Firstly, every print pattern is eventually restricted by the width of a primitive line (i.e. the printing resolution). Besides the printing resolution it is secondly defined a bitmap resolution. The bitmap resolution is defined for those structures of a print pattern that are only composed of unit pixels and is equivalent to the unit cell dimensions associated with the respective nozzle row or nozzle array. In such a case, the size of said structures is restricted to integer values of the unit cell size along the relevant directions of the associated nozzle array and hence smaller unit cell sizes and the correspondingly higher nozzle densities generally result in higher bitmap resolution. Resolution, as well as bitmap resolution are not defined as global values for the whole print pattern. While the printing resolution is generally given by the nozzle diameter, and is accordingly different for nozzles of different diameter, the bitmap resolution depends on the unit cell size, which in principle can be defined differently for any two nozzles, even if said two nozzles have identical diameters.

A unit pixel represents one of the most universal print pattern segments, the ample use of which allows a considerable reduction in the number of required contact points. Another preferable print pattern segment that serves amongst the most universally useful is a single primitive line that is oriented along the primary unit cell orientation at the location of the main corner of said unit cell and that has a length that is identical to the primary unit cell length of the outer boundary. In the following, print pattern segments fulfilling this requirement will be denoted as "unit lines". While unit lines are reduced along the secondary unit cell orientation to the smallest possible features size, i.e. to the width of a single primitive line, their feature size along the primary unit cell orientation is still limited by the length of the unit cell.

In order to avoid the restriction on structural elements that are imposed by the sole use of unit pixels and unit lines, arbitrary structures can be printed. In the following, arbitrary structures are referred to as those print pattern segments which are neither formed as a unit pixel, nor as a unit line. Particularly, an arbitrary structure can comprise a patch that is made of lines having irregular length and/or it can be comprised of a series of parallel line segments that are arranged along the secondary unit cell orientation and/or it can comprise curved lines and/or it can comprise arbitrary arrangements of patches that are all formed inside the same unit cell. Arbitrary structures can be combined with unit pixels and/or unit lines and/or with other arbitrary structures, wherein combining describes the process of attaching an arbitrary structure according to the introduced principles of overlapping lines at the common edge between two neighboring unit cells. For example, a line formed by a nozzle row of equally sized unit cells may be extended by an arbitrary structure that comprises a line segment having half the length of the unit cell along the primary orientation. In most cases the introduction of every arbitrary structure will be accompanied by the requirement for an additional contact point, which is why the number of unique arbitrary structures is preferably restricted such that it complies with the number of available contact points. However, in a preferable situation an arbitrary structure can be printed while being connected to the same contact point as a unit line or a unit pixel, for example if the same print pattern segment is contained in two differently sized unit cells. As unit cells can be defined with much freedom, the formation of differently sized unit cells for representing the same print pattern segment does not pose an ambiguity to the general considerations of the disclosed invention. Indeed, it is preferable that the unit cells of a nozzle row or of a nozzle array are formed with identical size, even if at least one of these unit cells contains structural elements that may actually be enclosed by a smaller unit cell. Particularly, this is due to the fact that the reference nozzle position of a nozzle array or a nozzle row should be defined such that the separation between the nozzles is constant.

If primitive lines of certain width are to be printed, they are formed by ejecting droplets of sufficiently small diameter. The size of droplets in turn depends on the diameter of the nozzle and therefore certain line widths can only be obtained when using sufficiently small nozzle diameters. However, this is very different when printing patches and particularly when printing full pixels. Besides influences on the edge roughness and the like, the printing resolution is generally not of specific importance to the structural geometry of a unit pixel, as long as the printing resolution is still several times higher than the bitmap resolution. When designating a nozzle for printing patches, its diameter can therefore be chosen more freely. While a small nozzle generally offers higher printing and bitmap resolution, a comparably larger nozzle generally offers higher printing throughput. Therefore, combining nozzles of different diameter on the print head is a preferable method of optimizing printing throughput while still providing the required resolution capabilities where they are required. The variation in throughput of two differently sized nozzles depends on what exactly is being printed. Generally, the volumetric ejection flow rate approximately scales with the cube of the nozzle diameter, but only if a nozzle is considered by itself. For example, if a primitive line has to be printed that is shorter than the minimum attainable separation between any two nozzles on the print head, said primitive line must indeed be printed by a single nozzle and hence the printing duration approximately scales with the inverse of the cube of the nozzle diameter. However, if the required primitive line is substantially larger than the minimum attainable separation between at least the smallest nozzles on the print head, said primitive line may be printed by combining the output of several nozzles that are part of a nozzle row. Doubling the diameter of the nozzles will also result in an approximate doubling of the nozzle separation in said nozzle rows, implying that only half as many nozzles can be employed to print said primitive line. Therefore, the approximate printing duration will only scale with the inverse of the square of the nozzle diameter, since the increase in throughput is opposed by a smaller nozzle density when changing to a larger nozzle, the nozzle density when printing said primitive line being proportional to the inverse of the nozzle diameter. The difference in throughput is further modified when printing patches that are substantially larger along both unit cell orientations than the minimum attainable separation between at least the smallest nozzles on the print head, said nozzles belonging to at least two nozzle rows of a nozzle array. Changing to a smaller nozzle diameter then not only allows a larger nozzle density along the primary unit cell orientation of the nozzle array but also along the secondary unit cell orientation of the nozzle array, essentially doubling the density effect. Hence, the approximate printing duration will only scale with the inverse of the nozzle diameter, since the increase in throughput is opposed by a smaller nozzle density when changing to larger nozzles, the nozzle density when printing a patch being proportional to the inverse of the square of the nozzle diameter.

Regarding throughput, printing of any kind of structure is preferably performed with nozzles of largest attainable diameter. The use of large diameter nozzles is further preferable with regard to the reliability of print head manufacturing and operation. The larger the nozzles the less likely it is that a single nozzle is improperly fabricated, wherein the generally smaller nozzle density further reduces the likelihood of nozzle defects during fabrication due to the general reduction in the number of produced nozzles per print head. Also during operation, larger nozzles are less prone to damages that can occur during operation, particularly they are less prone to clogging.

The duration for printing a given print pattern depends, amongst others things, on the number of different unit cell orientations being defined. Two primitive lines that are aligned with differently oriented unit cells cannot be printed simultaneously while any two primitive lines with identical orientation can in principle be printed at the same time based on appropriate nozzle placement. Hence, the print head must first print all primitive lines with a first orientation, followed by sequentially printing all primitive lines of at least one further orientation. The time required for concluding a unit cell orientation thereby depends on the maximum number of primitive lines that are associated with a single unit cell. Because patches are generally formed of many primitive lines, the formation of a unit pixel is generally much more time-consuming than the printing of a unit line, for example. It is therefore preferable that all patches, meaning unit pixels as well as those patches having arbitrary shape, are being formed at a smallest possible number of unique unit cell orientations, most preferably all patches are printed from primitive lines of one unique orientation such as to enable their simultaneous printing. The common unit cell orientation is preferably chosen such that the affected nozzles can print their print pattern segments with a smallest possible number of contact points. Any optimization routines to the nozzle arrangement, targeted at either a reduction in printing duration or at a reduction in the number of required contact points can be accompanied by adjustments to the print pattern itself, wherever such adjustments are not degrading structural functionality. In this sense a reduction in printing duration can also be achieved by minimizing the number of unit cell orientations that are required for printing all unit lines, wherein such reductions can be facilitated by forming print patterns that consist of primitive lines that are restricted to a set of given orientations. The duration for printing a given print pattern also depends on the time required for concluding arbitrary structures. As stated before, patches can generally be printed along a common unit cell orientation, including such patches that are formed with arbitrary shape. Arbitrary structures on the other hand can also be formed from curved primitive lines that are not relying on a specific unit cell orientation. Such curved primitive lines have to be printed separately from straight primitive.

Primitive lines resemble the printable structures with the smallest feature size, at least along their width. Primitive lines can be used to form patches but they can also provide functionality as a single entity. While two isolated primitive lines of different orientation cannot be printed simultaneously, it is possible that one of these two primitive lines is not actually printed as a primitive lines but as a patch. In this case, both of the respective nozzles are being associated with unit cells of identical orientation, wherein one on the two lines is formed as a primitive line, while the other line is formed as narrow patch from a number of ultrashort primitive lines that are overlapped along the secondary unit cell orientation. Essentially, said short line segments may only consist of a single droplet that is ejected with high precision once the nozzle, during a movement, is positioned at the intended position above the substrate. Because it can be difficult to exactly time the ejection of one single droplet with electrohydrodynamic printing, and/or in order to create higher line thickness, the line segment can also consist of several overlapping droplets. Preferably, the nozzle is activated for a duration that is equivalent to the width of the respective primitive line divided by the movement velocity during printing. A line (i.e. a narrow patch) being printed from a given nozzle as a patch will not be as well-defined as a comparable single primitive line. For example, lines printed as an assembly of short primitive lines will generally have inferior line edge roughness and will be wider than the individual primitive lines they are made of. Hence, with regard to printing quality, lines are preferably only considered to be printed as a patch if such execution results in a reduction of printing duration. This is achieved if sufficient portions of the individual printing movements of two differently oriented primitive lines can be consolidated if one of the two primitive lines is converted into a line-like patch.

A print pattern according to the present invention can be printed by a print head if every nozzle only prints the print pattern segment it is assigned to. In this case the maximum magnitude of the individual printing movements is defined by the unit cell dimensions that are associated with a particular nozzle. It is possible, however, that unit cells are defined that are of different size but identical orientation. In this case it is very likely that the maximum magnitudes of the respective individual printing movement are different as well. When moving by a distance that is larger than required by the unit cell of a given nozzle, said nozzle may be deactivated once the movement magnitude becomes larger than suggested by the inner boundary of its unit cell. However, instead of being deactivated, the nozzle may be used to print at least part of the thickness of at least part of the print pattern segment that is assigned to one of its neighboring nozzles. Particularly, if a nozzle is part of a nozzle row, extension of the movement beyond the magnitude given by the inner unit cell boundary enables a nozzle to print a second layer onto the primitive line of at least one of its neighboring nozzles along the movement direction. Of course this is only possible if the primitive line to be overprinted is situated at the proper offset position along the secondary unit cell orientation. For nozzle rows this is particularly fulfilled if the length of a primitive line is formed as a composite of several segments, of which each is part of an own print pattern segment. Hence, an extended movement distance can be used by the nozzles of the nozzle row to print at least one further layer onto part of the primitive line. Furthermore, overprinting at least part of a neighboring print pattern segment during extended movement has the additional benefit that a certain primitive line is not solely printed by a single nozzle. This improves process reliability through the introduction of printing redundancy. Accordingly, in the following this form of overprinting where a nozzle prints at least part of the thickness of at least part of another print pattern segment (i.e. one that said nozzle is not assigned to) will be termed "redundant overprinting". Due to the added benefit of process redundancy, at least parts of a print pattern can be formed by redundant overprinting at will, by targeted extension of the movement magnitude beyond the required value. As will be shown below, the use of redundant overprinting is generally to be anticipated already at the design stage as implementation requires for certain adjustments on the print head design, particularly on the distribution of nozzles and on their association with the different contact points.

In order to comply with the print pattern segments that are assigned to the individual nozzles of the nozzle row, redundant overprinting requires the nozzles of the nozzle row to obtain different triggering sequences. If a nozzle row is moved by a distance that is longer than the primary unit cell size of the inner unit cell boundary, the leading nozzle, i.e. the nozzle that is at the front of the nozzle row in movement direction, will generally not be able to overprint the primitive line segment of a neighboring print pattern segment, as there is no further nozzle defined for the nozzle row along the required direction. Hence, the leading nozzle must be deactivated once the movement magnitude equals the primary unit cell length of the inner unit cell boundary. The leading nozzle must therefore be triggered differently than the other nozzles of the nozzle row and accordingly be connected to a separate contact point. If the forward movement is further extended, the same will periodically occur with any further nozzle that reaches beyond the boundaries designated by the unit cell of the leading nozzle and it is therefore preferable that such further nozzles are deactivated as well upon such occurrence. By doing so, the length of the printed primitive line can be kept at its intended value. It also occurs that the line segment printed by the terminal nozzle, i.e. the nozzle at the other end of the nozzle row, is generally not itself being overprinted by a neighboring nozzle, which is why the line segment of the terminal nozzle only comprises one layer instead of at least two layers. Said at least one missing layer of the terminal nozzle can be printed, for example, by performing a reversed movement, wherein no nozzle is activated until the nozzle located next to the terminal nozzle passes across the primitive line segment assigned to the terminal nozzle, which is then to be activated. The line segment assigned to the terminal nozzle can be overprinted by further layers by extending the backward movement and periodically activating the respective nozzles situated above the primitive line segment that is assigned to the terminal nozzle, until said primitive line segment obtains the desired thickness. The same overprinting procedure that is executed for the at least one missing layer associated with the primitive line segment of the terminal nozzle can also be employed for any other nozzle that requires at least one further layer after completion of an initial movement. Because this procedure involves at least two nozzles that are activated/deactivated at different times, said at least two nozzles must also be connected to different contact points.

If a primitive line is printed by a nozzle row during redundant overprinting, it is preferable that the extended movement during printing is chosen as an integer multiplier of the primary unit cell length of the inner unit cell boundary, such that the individual line segments of neighboring nozzles are properly overlapped, resulting in a uniform line topography. With respect to the uniformity of the line topography, the use of redundant overprinting also reduces the topographical inhomogeneities at the overlapping positions between the primitive line segments of two neighboring nozzles. In case that a required line thickness is obtained by cycles of non-redundant overprinting only, i.e. by printing forth and back within the boundaries of a unit cell, every half-cycle results in another overlap between the newly printed primitive line segments of two neighboring nozzles, said overlap being topographically inhomogeneous due to the rounded nature of the primitive line endings. In contrast, one single forward movement that creates at least two primitive line layers by redundant overprinting only results in one such overlap, because the primitive line segments created by the nozzles can cover several overlap points before they terminate. However, this also implies that the outer boundary of the unit cell is not properly defined anymore. Because a primitive line segment may terminate at only one or none of the two overlap points between along the primary orientation of a unit cell, its own width has only partial or no influence on the length of the primitive line segment, respectively. Hence, it is preferable that the outer unit cell boundary of selective unit cells becomes identical along the primary unit cell orientation to the inner unit cell boundary. Because the outer unit cell boundary defines the overlapping edge of two neighboring nozzles, said two nozzles will be formed at a closer separation on the print head, if the distance between their inner and outer unit cell boundary is reduced. The distance between the inner and outer unit cell boundary can still be introduced at the required positions, meaning that at least two neighboring nozzles of a nozzle row can be formed with a different separation than all other nozzles of the nozzle row. Importantly, the size of the inner unit cell boundary along the primary unit cell orientation is preferably always the same inside a nozzle row, as explained above.

In the following the creation of at least two primitive line layers by redundant overprinting will be described on the basis of steps, wherein one step corresponds to a movement distance of one time the primary unit cell length of the inner unit cell boundary (i.e. no redundant overprinting), and wherein two steps are equivalent to a movement distance of two times the primary unit cell length of the inner unit cell boundary (i.e. one additional layer created by redundant overprinting), and so forth. Redundant overprinting can also be cycled by printing a structure with at least one backward movement, and desired number of repetitions.

In case that a line has to be uniform in its thickness and be printed with its intended length, creating layers by redundant overprinting comes at the cost of an increased requirement on the number of contact points that a nozzle row needs in order to be operated. Also, printing a certain number of primitive line layers generally requires for a longer accumulated movement distance compared to non-redundant overprinting. Printing a primitive line with a thickness of n layers by redundant overprinting during a single half-cycle can require for more than n movement steps and for more than one contact point. In comparison, creating the same n primitive line layers by non-redundant overprinting requires exactly n half-cycles (of one step each) and only one contact point. Besides the benefit of redundancy and reduced inhomogeneity at the connection point of line segments, redundant overprinting does therefore also imply clear drawbacks. At least the requirement for an extended number of steps can be circumvented though by introducing supporting nozzles to the print head next to the nozzle row. Such supporting nozzles are either added next to the terminal or the leading nozzle of the nozzle row (more details below) and have the sole purpose of redundantly overprinting the primitive line segment assigned to at least one neighboring nozzle in movement direction. No print pattern segment is assigned to these supporting nozzles, i.e. their unit cells are empty, and hence they can only occupy the space of a print head that is not already blocked by a nozzle that is assigned to a print pattern segment. In return, the use of supporting nozzles allows the creation of a uniform, n layer thick primitive line in n steps by redundant overprinting. Besides certain drawbacks, redundant overprinting is considered as an important facilitator of reproducible and importantly, of the quick realization of a print pattern. Indeed, the use of redundant overprinting enables unit lines and/or unit pixels to be printed simultaneously even if the length of their corresponding unit cells is different.

Performing redundant overprinting simultaneously with the nozzles of unit cells of at least two different primary unit cell sizes requires for dedicated movements and well-controlled triggering sequences. The most straightforward way of performing redundant overprinting is by the use of supporting nozzles in which case the required number of steps is executed without any further considerations, wherein each redundantly printed layer (i.e. every layer beyond the non-redundant first layer) requires for one supporting nozzle to be added to the terminal nozzle of a nozzle row. For example, printing n layers requires for n−1 supporting nozzles to extend the nozzle row from the side of the terminal nozzle. In order to reduce the complexity of the actuation electronics, it is preferable that the unit cells are chosen according to certain boundary conditions. When using supporting nozzles, each step executed by a nozzle row can create one primitive line layer, implying that a single step based on the size of the inner unit cell along the primary orientation creates one primitive line layer by the respective nozzle row, but wherein two layers can be printed by the same movement, if a nozzle row is employed that contains unit cells with an inner boundary being only half as large as that of the first unit cell. Hence, the largest unit cell associated with a number of simultaneously printing nozzles is preferably chosen such that the size of its inner boundary along the primary orientation is 2y times the primary unit cell size of the inner boundary of any smaller unit cell. This assures that none of the participating nozzle rows prints inefficiently, wherein inefficiency in connection with the supporting nozzle technique means that a movement of n steps based on the unit cells of the respective nozzle row results in a uniform line incorporating less than n layers. Furthermore, the proper scaling of unit cells can enable a number of redundantly printing nozzles to create the same structural elements with a lesser number of individual contact points. During a movement with given magnitude the unit cells having smallest primary unit cell size will generally print the most layers and will therefore require for the largest number of individual contact points. Each contact point provided to the nozzles of the nozzle row thereby supplies triggering sequences with particular ON/OFF commands that are generally switched with a period that is fixed to the duration of moving by one step. The variety of different triggering commands that are required for actuating the nozzles associated with the smallest primary unit cell length can thereby be adequate also for controlling any nozzle belonging to a larger unit cell, in case the primary unit cell size of their inner boundaries are properly scaled. In order to form lines of uniform thickness, nozzles belonging to a nozzle row must be triggered such that the primitive line segment assigned to every nozzle attains the same number of layers, such that from all nozzles passing over the print pattern segment, only such a number of nozzles actually prints during said passage that is identical to the total number of primitive line layers to be printed.

In case no supporting nozzles are employed when printing with a nozzle row, the situation is more complicated because uniform line printing cannot be executed without shifting the nozzle position at some point. As introduced above, formation of primitive lines of uniform thickness may be commenced by first printing during a number of steps in a forward movement, after which the print head is shifted, followed by a second number of steps, preferably in a backward movement. Besides the requirement of a shifting step that depends on the unit cell size, this method does not readily allow sharing of contact points between the nozzles of differently sized unit cells. The movements and actuation sequences can be standardized, however, by quickly shifting the print head along the primary unit cell orientation prior to printing initiation, followed by a continuous movement in opposite direction. Essentially, the print head is shifted with regard to the substrate, such that at least one nozzle at the terminal end of the nozzle row mimics a supporting nozzle for the respective nozzle row. In case that only one unit cell size is employed during printing, the initial shifting movement is preferably chosen as n−1 steps. However, as soon as one attempts the simultaneous use of unit cell with different primary unit cell length, the initial re-positioning step is only appropriate for the unit cell size that it has been defined for. This can be circumvented by forming the affected nozzles on the print head at another reference nozzle position than the otherwise preferable main corner of their at least one unit cell. If redundant overprinting is solely going to be performed along the primary unit cell orientation, it is then preferable that all nozzles that are about to be executed during said redundant overprinting are formed at the center of the edge of the inner boundary of their unit cell, said edge being the one that is parallel to the primary unit cell orientation and being in contact to the main corner of the unit cell. Along this line, it should be noted that the main corner remains the preferable location of the nozzle with respect to its unit cell, for all situations in which no initial shifting movement is performed between print head and substrate prior to printing with a number of nozzles. Hence, it is preferable that a main corner is initially defined also for unit cells that have their nozzles eventually placed at another location than said main corner of the unit cell. The initial dislocation between print head and substrate is then preferably chosen according to the employed nozzle that is associated with the largest primary unit cell length, wherein the dislocation is adjusted to the new position of the nozzle inside the unit cell and preferably is n−0.5 steps in counter-direction of the subsequent movement during printing. The number of layers n that can be printed by differently sized unit cells during a common movement will not be identical, with smallest unit cells generally achieving the largest number of layers.

Placing a nozzle at a different location than the main corner of its at least one unit cell implies that even printing with a single step (i.e. not involving redundant overprinting) is preferably preceded by an initial shifting movement between print head and substrate by 0.5 steps.

When performing redundant overprinting without the use of supporting nozzles, the total movement distance is preferably chosen as 2n−1 steps, if lines of uniform thickness are to be obtained. Every primitive line layer beyond the first one is therefore printed with inherent inefficiency, i.e. the number of steps is higher than the total number of primitive line layers created, unless non-uniform line thicknesses are acceptable. Efficiency will be even lower if differently sized unit cells are not formed with a primary unit cell length of their inner boundaries that is properly scaled. When performing redundant overprinting with at least one nozzle row that does not contain supporting nozzles, the largest inner unit cell boundary of a number of simultaneously employed nozzles is preferably chosen $3y$ times larger than the inner unit cell boundary of any smaller, simultaneously employed nozzle, wherein y is an integer value. For example, a given movement distance that is equal to the primary unit cell length of the largest unit cell will lead the respective nozzle row to print one primitive line layer, while a nozzle row containing three times smaller unit cells can perform three steps during the same movement and according to the 2n−1 relationship can therefore print exactly two primitive line layers during the same movement. It is also important to note that the nozzle row containing the smallest unit cells generally creates most layers during a certain movement distance, and therefore requires for the largest number of individual contact points. Any nozzle row containing unit cells of a given primary unit cell length of the inner unit cell boundary can generally share their contact points with at least one nozzle associated with comparably smaller unit cells, in case the unit cells of the two nozzle rows are properly scaled.

When attempting to redundantly print a certain number of primitive line layers by a continuous forward movement along the primary unit cell orientation, at least an equal number of nozzles have to be aligned in the respective nozzle row. Every movement step that goes beyond the number of available nozzles will not result in further thickening of the line, if a uniform thickness is required. Thicker layers are then only obtained if supporting nozzles are added to the nozzle row or if printing is performed in forward-backward cycles.

It is also possible to perform redundant overprinting simultaneously with nozzle rows of both kinds, those having supporting nozzles and those not having supporting nozzles. However, such simultaneous use of both types of nozzle rows must be anticipated already when forming the nozzles on the print head. Because a shifting movement of n−0.5 steps will be required prior to printing initiation, supporting nozzles as well as all other nozzles will be displaced from their intended positions relative to the substrate. The displacement can be coped with by forming supporting nozzles at another position of the print head with respect to the nozzle row they are associated with. Instead of arranging all supporting nozzles at the terminal end of the nozzle row, it then becomes preferable that supporting nozzles are evenly distributed to the terminal and the leading end of the nozzle row. In case an odd number of supporting nozzles is employed, the last remaining supporting nozzle is preferably arranged at the terminal end of the nozzle row. In addition, it is preferable to form the nozzle of such nozzle rows at a different reference nozzle position then their otherwise preferable main corner. If an odd number of supporting nozzles is added to a nozzle row, the nozzles are preferably formed at the corner of the inner boundary of the unit cell that is opposite to the main corner along the primary unit cell orientation. If an even number of supporting nozzles is added to a nozzle row, the nozzles are preferably formed at the same positions as the nozzles associated with nozzle rows that redundantly print without supporting nozzles, i.e. at the center of the edge of the inner boundary of the unit cell that is connected to the main corner and is parallel to the primary unit cell orientation. Printing is preferably executed according to the preferable procedure performed with nozzle rows that do not contain supporting nozzles. Particularly, printing is initiated after a shifting movement of n−0.5 times the primary unit cell length of the employed nozzle associated with the largest primary unit cell length, wherein the movement distance during printing is preferably chosen as an integer value of said largest primary unit cell length. Most preferably, the choice of the length of the inner unit cell boundary along the primary unit cell orientation is based on a common largest primary unit cell length, such that unit cells can be scaled on the basis of a common reference.

Redundant overprinting is not restricted to the primary unit cell orientation. When offsetting the print head/substrate position along the secondary unit cell orientation during patch printing, said offset can lead the nozzle of a first unit cell to extend its printing beyond the boundaries set forth by said first unit cell and into the boundaries of a second unit cell. The nozzle of said first unit cell thereby starts to form primitive lines on top of the primitive lines that that are assigned to a second nozzle. The accumulate offset distance can be further extended along the secondary unit cell orientation until the first nozzle reaches the inner boundaries that are set forth by an even further unit cell, wherein the first nozzle can be employed to overprint the primitive lines contained within the area set forth by the outer boundary of said further unit cell. Redundant overprinting along the secondary unit cell orientation creates a stack of at least two primitive lines that can themselves be made of several layers that are created during redundant overprinting along the primary unit cell orientation. Hence, the term patch layer will be used when denoting the degree of redundancy along the secondary unit cell orientation, wherein one patch layer refers to the situation when no redundant overprinting along the secondary unit cell orientation takes place.

When performing redundant overprinting along the secondary unit cell orientation, inhomogeneities at the overlapping edge between two neighboring unit cells can be circumvented by choosing the distance between inner and outer unit cell boundary at half the width of the primitive lines. However, when extending the offset magnitude beyond the length set forth by the inner unit cell boundary, the movement magnitude that is required to cover to whole next unit cell also includes the distances between the inner and outer unit cell boundaries. Accordingly, where required, it is preferable that also along the secondary unit cell orientation the distance between the inner and outer unit cell boundary is decreased to zero and the nozzles are being formed on the print head at a closer separation.

Redundant overprinting along the secondary unit cell orientation can be performed either with supporting nozzles or without supporting nozzles, wherein the preferable arrangement of supporting nozzles, the preferable choice of the secondary unit cell length and the preferable procedures in printing execution follow the considerations relating to redundant overprinting along the primary unit cell orientation. Particularly, the secondary unit cell lengths of differently sized unit cells are preferably chosen such that the unit cell having largest secondary unit cell length is either 2y or 3y times larger along the secondary orientation than that of any other simultaneously printing nozzle, wherein a value of 2y is preferable when supporting nozzles are being employed, and wherein a value of 3y is preferable when no supporting nozzles are being employed. If redundant overprinting along the secondary unit cell orientation exclusively involves nozzle arrays that are equipped with supporting nozzles, all of said supporting nozzles are preferably arranged along the secondary unit cell orientation next to the terminal array nozzles, wherein a terminal array nozzle is understood as the last nozzle of a nozzle array in direction of the secondary unit cell orientation, on the side of the nozzle array that is opposite to the movement direction of the print head relative to the substrate during printing. It is further preferable that for every patch layer that is redundantly printed along the secondary unit cell orientation (i.e. every patch layer beyond the first, non-redundant patch layer), the nozzle array is extended by one additional supporting nozzle on the side of the terminal array nozzle. Redundantly printing with nozzle arrays that exclusively use supporting nozzles can be initiated without any prior shifting movement of the print head along the secondary unit cell orientation, wherein the accumulated offset distance is preferably chosen as n times the secondary unit cell length of the employed nozzle that is associated with the largest secondary unit cell length.

In case that redundant overprinting is going to be solely performed along the secondary unit cell orientation by at least one nozzle array that does not use supporting nozzles, it is preferable to define the reference nozzle position of all simultaneously printing nozzles at the center of the edge of their unit cell, the edge being the one that is parallel to the secondary unit cell orientation and that is in contact to the main corner. It should be noted that printing along the primary and secondary unit cell orientations are independent from each other in this regard such that the choice in operational execution for redundant overprinting along the secondary unit cell orientation is not dependent on whether supporting nozzles are employed for printing along the primary unit cell orientation. Performing redundant overprinting solely along the secondary unit cell orientation with at least one nozzle array that does not use supporting nozzles, printing is preferably executed after first performing a shifting movement between print head and substrate. This shifting movement is executed in counter-direction of the subsequent movement direction along the secondary unit cell orientation during printing, by m−0.5 times the secondary unit cell length of the largest unit cell that is simultaneously printed with, wherein m is understood as the total number of patch layers to be printed. The accumulated movement distance along the secondary unit cell orientation during redundant overprinting is preferably chosen as 2m−1 times the secondary unit cell length of the employed nozzle that is associated with the largest secondary unit cell length. When attempting to redundantly print a certain number of patch layers by moving by an accumulated offset distance along the secondary unit cell orientation, at least an equal amount of nozzles have to be aligned along the secondary unit cell orientation.

In case that redundant overprinting is about to take place along both, primary and secondary unit cell orientation by at least one nozzle row and one nozzle array, respectively, that do not use supporting nozzles, the two preferably executed initial shifting movements for primary and secondary orientation, respectively, are preferably executed sequentially or in parallel before printing is initiated. Furthermore, the reference nozzle position is to be defined according to the requirements of both main unit cell orientations. The preferable reference nozzle position when performing redundant overprinting solely along one of the two main unit cell orientations can be regarded as a vector originating from the main corner. If redundant overprinting is performed along primary, as well as secondary unit cell orientation, the nozzle is preferably formed at a reference nozzle position that is defined from the vector addition of both vectors that are individually defined for any of the two main orientations. For example, when performing redundant overprinting along both main unit cell orientations, at the absence of supporting nozzles, all simultaneously employed nozzles are preferably formed at the center of the respective unit cell.

Redundant overprinting along the secondary unit cell orientation can be simultaneously performed with nozzle arrays containing supporting nozzles and with nozzle arrays containing no supporting nozzles. To do so, it is preferable to distribute supporting nozzles at equal number next to the terminal array nozzle and next to the leading array nozzle, wherein the leading array nozzle is understood as the nozzle that is at the opposite end of the nozzle array compared to the terminal array nozzle. In case an odd number of supporting nozzles is distributed, the additional nozzle is preferably arranged to the side of the terminal array nozzle. The different situations associated with the use of odd or even numbers of supporting nozzles can be counterbalanced by forming the respective nozzles on the print head at different locations with respect to their unit cells. If an odd number of supporting nozzles is added to a nozzle array, and if redundant overprinting is solely to be performed along the secondary unit cell orientation, the nozzles are preferably formed at the corner of the inner unit cell that is opposite to the main corner along the secondary unit cell orientation. If an even number of supporting nozzles is added to a nozzle row, and if redundant overprinting is solely to be performed along the secondary unit cell orientation, the nozzles are preferably formed at the center of the edge of the unit cell that is connected to the main corner and that is parallel to the secondary unit cell orientation. Printing is preferably executed according to the preferable procedure used when performing redundant overprinting with those nozzle arrays that do not employ supporting nozzles. Particularly, printing is initiated after a displacement step of m−0.5 times the secondary unit cell length of the employed nozzle being associated with the largest secondary unit cell length, and wherein the subsequent offset movement along the secondary unit cell orientation is preferably chosen in magnitude as an integer value of said largest unit cell. Preferably, the choice of secondary unit cell lengths for nozzle arrays of either type, with or without supporting nozzles, is based on a common largest secondary unit cell length, such that unit cells can be scaled on the basis of a common reference.

When performing redundant overprinting along the secondary unit cell orientation, proper allocation of the printed material within the area of the respective outer unit cell boundaries as well as control of the uniformity of the patch thickness requires for appropriate activation/deactivation of the nozzles during the printing movement. This is achieved by selectively introducing new triggering sequences that can control the individual situation of every nozzle inside the nozzle array and accordingly, not all nozzles of the nozzle array can be associated with the same contact point anymore, even if they are assigned to identical print pattern segments. As with redundant overprinting along the primary unit cell orientation, printing m patch layers will generally require for more than m contact points. However, proper scaling of the different secondary unit cell lengths of any array type (with or without supporting nozzles) generally allows that all contact points required by the nozzle arrays of the smallest secondary unit cell length can be used by larger unit cells as well, respectively. In order to form patches of uniform thickness by redundant overprinting along the secondary unit cell orientation, nozzles belonging to a nozzle array must be triggered such that the primitive line segments inside every print pattern segment attain the same number of patch layers. It is understood that the period at which a nozzle of such a nozzle array can be activated/deactivated is preferably fixed by the duration that is required to perform an accumulated offset distance that is equivalent to the secondary unit cell length, said period generally being substantially lower than the period at which nozzles must be switched during redundant overprinting along the primary unit cell orientation.

If redundant overprinting is performed along both unit cell orientations, primitive line segments that are printed during movements along the primary unit cell orientation become the input for patches that are redundantly printed along the secondary unit cell orientation and those line segments may contain several redundantly printed layers as well. Indeed, the total thickness of a structure is generally n·m times the thickness of one basic layer of a primitive line segment that is created without any overprinting. Unfortunately, a multiplication also occurs for the number of contact points that are required for operating the nozzles of the nozzle array. When printing a patch consisting only of unit pixels, redundant overprinting in primary unit cell orientation results in overprinting of unit lines, while redundant overprinting in secondary unit cell orientation results in overprinting of whole unit pixels. If redundant overprinting only takes place in one direction, the triggering signal of a nozzle will only be defined by the position of the nozzle along the respective unit cell orientation that is used for redundant overprinting, while the position along the other unit cell orientation is irrelevant for triggering considerations. If redundant overprinting is performed along the primary, as well as the secondary unit cell orientation, the triggering map becomes two-dimensional though. Hence, the total number of required contact points becomes the product of the number of individual contact points that are separately used for printing along any of the two unit cell orientations. For example, if 10 contact points are required for individually printing along any of the two unit cell orientations, the number of contact points required for combining the two unit cell orientations is going to be 100.

The number of required contact points for redundantly overprinting in two directions can be strongly reduced by decoupling the triggering requirements imposed by each of the two unit cell orientations, such that a nozzle of a nozzle array can be associated with two separate contact points, one that is related to controlling redundant overprinting along the primary unit cell orientation and one that is related to controlling redundant overprinting along the secondary unit cell orientation. To do so, at least two extraction electrodes can be formed, of which at least one is connected to either contact point of the two control levels (i.e. redundant overprinting along the primary or the secondary unit cell orientation). The extraction electrodes connected to different contact points must be electrically insulated from each other. Preferably the at least two extraction electrodes are formed as ring electrodes that are centered on the nozzle, wherein a preferable arrangement is to place the at least two extraction electrodes at a different axial distance from the nozzle and/or by arranging the at least two extraction electrodes at different radial distance from the nozzle. In order to reduce the count in required contact points it is preferable that droplet ejection is only activated if the extraction electrodes associated with any of the two control levels are activated (hereinafter referred to as double-actuation). In contrast, the activation of a single extraction electrode (hereinafter referred to as single-actuation) will not result in droplet ejection because the other extraction electrode preferably is kept at the same electric potential as the nozzle and partly shields the electric field of the activated extraction electrode, thereby lowering its effect on the nozzle. Preferably, the voltages applied by the two extraction electrodes are chosen such that the average electric field strength is essentially identical when actuating any of the two control levels by themselves, i.e. while the other control level is deactivated. During double-actuation, the average electric field at the nozzle can generally be increased by up to a factor of two. This limitation poses a threshold for the control of the ejection process because the maximum applicable voltage is limited by the requirement that activation of only one extraction electrode must not cause droplet ejection. If voltages become too high, droplets will be ejected even if one of the two extraction electrodes is deactivated. The range of the applicable average electric field strength can be increased by setting the deactivated control level to an electric potential that is different from that applied to the ink inside the nozzle, wherein the voltage formed between deactivated extraction electrode and ink is preferably of opposite polarity than the voltage formed between activated extraction electrode and ink. Doing so, the deactivated extraction electrode will cause a stronger shielding of the electric field of the activated extraction electrode and hence allows the application of a higher minimum ejection voltage during single-actuation.

The double-actuation scheme can be employed to control nozzles that are subject to two essentially independent triggering sequences. If a double-actuation scheme is employed, each signal can be forwarded to one extraction electrode. For example, a nozzle is either activated or deactivated due to the requirements it is subjected to because of redundant overprinting along the primary unit cell orientation or due to the requirements it is subjected to because of redundant overprinting along the secondary unit cell orientation. These two control levels may be separated into a higher and a lower control level, wherein control of redundancy along the primary unit cell orientation can be regarded as the lower control level and redundancy along the secondary unit cell orientation can be regarded as the higher control level. Indeed, the line that is created by redundant overprinting is the input for redundant overprinting along the secondary unit cell orientation. Nozzles inside a nozzle row are therefore controlled by the lower control level such as to create a required line feature by redundant overprinting, while said nozzle row can be activated or deactivated as a whole when the nozzles of said nozzle row are used for redundant overprinting along the secondary unit cell orientation. Using a double-actuation scheme, the total number of required contact points becomes the sum of the individual number of contact points that are required for redundant overprinting along each of the two unit cell orientations. For example, if 10 contact points are required for individually printing along any of the two unit cell orientations, the number of contact points required for combining the two unit cell orientations is going to be 20. As explained before, a single-actuation scheme would instead require for 100 contact points. Of course, nozzles that are actuated by two control levels can coexist with nozzles for which only a single extraction electrode is formed, even inside the same nozzle row or the same nozzle array. The use of two control levels can also be employed in other situations in which two triggering commands are independent and can therefore be separated into a lower and a higher control level. For example, the nozzles involved in redundantly overprinting a unit line can be activated once the respective nozzle row reaches the proper position along the secondary unit cell orientation. This is useful if the line itself is created by redundant overprinting for which several contact points are required in the first place. If the same line is printed by another nozzle row as well, but at different positions along the secondary unit cell orientation, only the triggering sequences that control the position of the line along the secondary unit cell orientation will differ between two nozzle rows, while the several contact points required for controlling individual line printing are identical. The presented scenarios must not be seen as a restriction to the general applicability of implementing two extraction electrodes with two separate control levels. It will be appreciated by a person skilled in the art that such extraction electrodes can be applied in many other application scenarios as well.

The disclosed invention is not limited to the controlled printing of two-dimensional shapes but can in addition create three-dimensional topography for every individual print pattern segment. For example, at least two parallel primitive lines can be printed with different thickness or a patch can linearly change in its thickness along some in-plane coordinate by controlling the respective thickness of the primitive lines it is made of. Further variations can be freely composed by selectively printing additional primitive line layers at the positions where a structure has to be thickened. For example, a structural elements that is initially formed as a unit pixel can eventually be thickened only at its center by printing primitive lines that are much shorter and are only deposited at selected that become smaller with every new layer that is added on top of the initial unit pixel. As a result, the respective nozzle cannot be assigned to the contact point that is commonly employed for printing unit pixels, but instead requires for an individual contact point. It is therefore preferable that every layer of a unit cell contains the same structural information such that the triggering sequence required for printing is identical for every layer, such that additional contact points can be omitted. Nevertheless, any two print pattern segments comprising the same 2D information can be made with different thickness without necessarily loosing compatibility to a common contact point. For example, the same patch can be printed with nozzles of different diameter, wherein the larger diameter nozzle generally prints thicker layers than the smaller diameter nozzle. Accordingly, during the same movements and by using the same triggering sequences, differently thick print patterns are created, which however, are equivalent in their two-dimensional appearance (apart from differences being based on variations in line width). Furthermore, control of the thickness of a structure can be provided by the use of two control levels. For example, two lines with different thickness can be printed from the same line segments in several printing cycles, the printing of individual line segments being controlled by a common set of contact points, and wherein a higher control level can employed to selectively deactivate wholes nozzle rows once the respective line obtains the required thickness. All other nozzle rows may continue printing for an extended number of cycles, still employing the same contact points for printing the individual line segments.

For aligning the unit cells of at least one print head to existing structures on the substrate one preferably chooses optical alignment procedures. For example, before printing onto a pre-patterned substrate an optically transparent material, such as a glass sheet, is employed as a substrate, wherein all nozzles or a selected group of nozzles can be used to print onto said substrate. By doing so, material deposits are created which can be optically imaged by a microscope that is placed below the substrate, and which can then be analyzed for their position, wherein the position of the material deposits stands representatively for the position of the nozzles on the print head as they transfer material onto the substrate. The position of the nozzles can be digitally stored as a reference map for the further processing. The material deposits on the dummy substrate can be optically allocated and assigned to a position by taking the central point of a 3D Gaussian profile that is formed of greyscale values around each of the measured features. Assignment of central impact positions can be substantially better than 100 nm by using this method. Once the impact positions are calibrated the substrate which was previously patterned by another or several other print head(s) can be coarsely orientated and fixed under the print head. Alignment can be performed on the basis of structural features that are printed anyways or it can be performed on the basis of dedicated alignment markers formed on the substrate. In order to perform accurate alignment it is preferable that the positioning system allows for accurate rotational and lateral correction, such as to match the position of the unit cells with the attempted position of their respective print pattern segments on the substrate. If the substrate itself is transparent to optical wavelengths, the positions of structures (e.g. of the alignment markers) can be analyzed in situ during the alignment process. Alternatively, the position of structures on the substrate can be optically analyzed before moving the substrate beneath the print head, wherein the position and geometrical outline of alignment-critical structures are matched with the coordinate system of the positioning system. Once analyzed, the substrate can be moved beneath the print head by a precise movement of known magnitude and direction, wherein alignment is performed on the basis of the stored data from pre-measured nozzle and structure position.

A preferable goal when designing at least one print head according to the disclosed invention is to reduce the global printing duration, the global printing duration being the time required to finalize the global print pattern by use of a restricted number of contact points available on the at least one employed print head. Besides the available number of contact points, a further boundary condition is the required resolution of the primitive objects as well as the accuracy of aligning any two primitive objects to a common coordinate system. For example, if the primitive objects require to be printed with highest possible alignment accuracy with respect to each other, it is preferable to print both primitive objects by the same print head and thereby profit from self-alignment, even if such a procedure increases the global printing duration.

The duration for printing the at least one total print pattern of a global print pattern depends on how long a print head requires to sequentially print all of the print patterns that the total print pattern is made of. As stated above, all print pattern segments of a print pattern can in principle be formed from primitive lines of an identical orientation. In the first place it can therefore be preferable to define all print pattern segments with unit cells of identical orientation. Further unit cell orientations may be introduced only in the course of design optimization. Also it can be further optimized the location, size and contact point-connection of nozzles, as well as the related processes during their operation. Such design optimizations relating to a total print pattern are then preferably performed with regard to a critical print pattern segment. As critical are defined those print pattern segments that, if printed infinitesimally quicker, reduce the overall printing duration of the whole total print pattern. A reduction in the time required for concluding a non-critical print pattern segment will not lead to an overall reduction in printing duration though. In contrast, it can even be useful to actually increase the time required for finalizing a non-critical print pattern segment. For example, if two patches of identical geometry have to be printed with a different thickness, the thinner patch will generally be concluded faster than the thicker one, which means that the respective nozzle assigned to any of the two patches cannot be operated with the same triggering sequence. If the thicker patch is already printed at maximum possible throughput, the printing duration of the thinner patch may therefore be selectively increased, for example by use of a nozzle with a smaller diameter that provides a lower volumetric rate of liquid ejection. As a result, it may become possible that the two patches are printed by the use of the same triggering sequence.

A reduction in global printing duration can generally only be obtained if said adjustments directly or indirectly reduce the duration for finalizing a critical print pattern segment. Minimization of the global printing duration is therefore strongly tied to attempts in reducing the printing duration of the critical print pattern segments, and hence any disclosed procedures that provide a means for reducing global printing duration are preferably first evaluated with regard to critical print pattern segments. However, the global printing duration may not only depend on the duration for finalizing a single total print pattern but may involve the finalization of at least one more total print pattern segment that is printed by at least one further print head. For example, certain adjustments that involve more than one print head can cause the one of these print heads to finalize its total print pattern quicker, while the other print head suddenly takes longer to finalize its total print pattern due to the same adjustments. Hence, the global printing duration can only be reduced if the sum for finalizing every individual total print pattern is effectively reduced by an adjustment.

In the process of reducing the printing duration of critical print pattern segments, said critical print pattern segments may effectively become non-critical, wherein at the same time at least one previously non-critical print pattern segment becomes critical and thereby moves into the focus of evaluating further adjustments of the print head design and/or the print head operation. Non-critical print pattern segments can be targeted for such adjustments, if the adjustments indirectly enable a reduction of the printing duration of at least one critical print pattern segment. Such indirect influences on the critical print pattern segments can also be based on freeing contact points that can then be used to allow at least one critical print pattern segment to be operated with a higher degree of control, thereby enabling a reduction of the respective printing duration, for example by implementing a higher degree of redundant overprinting for said at least one critical print pattern segment.

In the following, preferred embodiments are presented:

FIG. 1: It is shown a printing system (100) comprising a controller (10) and a print head (1) according to the disclosed invention, the print head (1) being tailored to the printing of a print pattern (2), the print pattern (2) being composed of material (ink) to be printed by the print head (1) onto a substrate (4) that is arranged beneath the print head. The ink can be printed onto the substrate (4) by means of nozzles having appropriate diameter (5*a*, 5*b*) and by their respective extraction electrodes (51) that are formed on the print head (1). Each extraction electrode (51) is connected to one contact point (52) by conductive tracks (53). Every nozzle (5*a*, 5*b*) is formed on the print head (1) such that it can be assigned to the printing of one segment (21*a*, 21*b*, 21*c*, 21*d*, 21*e*, 21*f*) of the print pattern (2), wherein each print pattern segment (21*a*, 21*b*, 21*c*, 21*d*, 21*e*, 21*f*) is outlined by one rectangular unit cell (22*a*, 22*b*), the orientation and size of which indicates preferable movements of the print head (1) relative to the substrate (4) during the process of printing the print pattern (2), such that the print pattern segments (21*a*, 21*b*, 21*c*, 21*d*, 21*e*, 21*f*) can be printed solely by the use of the respective assigned nozzle (5*a*, 5*b*). For visual clarity, the inner boundary of the unit cells (22*a*, 22*b*) are not drawn in the figure. Preferably, the formation of nozzles is therefore performed in line with a projection of the print pattern (200) and the unit cells (220*a*, 220*b*) onto the surface of the print head (1). Here, all nozzles (5*a*, 5*b*) are formed such that unit cells (220*a*, 220*b*) and the respective projected print pattern (200) can be projected onto the print head such that the nozzles (5*a*, 5*b*) become incident with a corner of the unit cell (22*a*, 22*b*). All nozzles (5) assigned to such unit cells (220*a*, 220*b*) being associated with an identical print pattern segment (21*a*, 21*b*, 21*c*, 21*d*, 21*e*, 21*f*) have their respective extraction electrodes (51) connected to the same contact point (52). For printing, the print head (1) and/or the substrate (4) can be moved by a positioning device (6*a*, 6*b*) relative to one another while ejection of droplets from the nozzles is controlled by the signal provided through the contact points (52) to the extraction electrodes (51).

Figure 2:
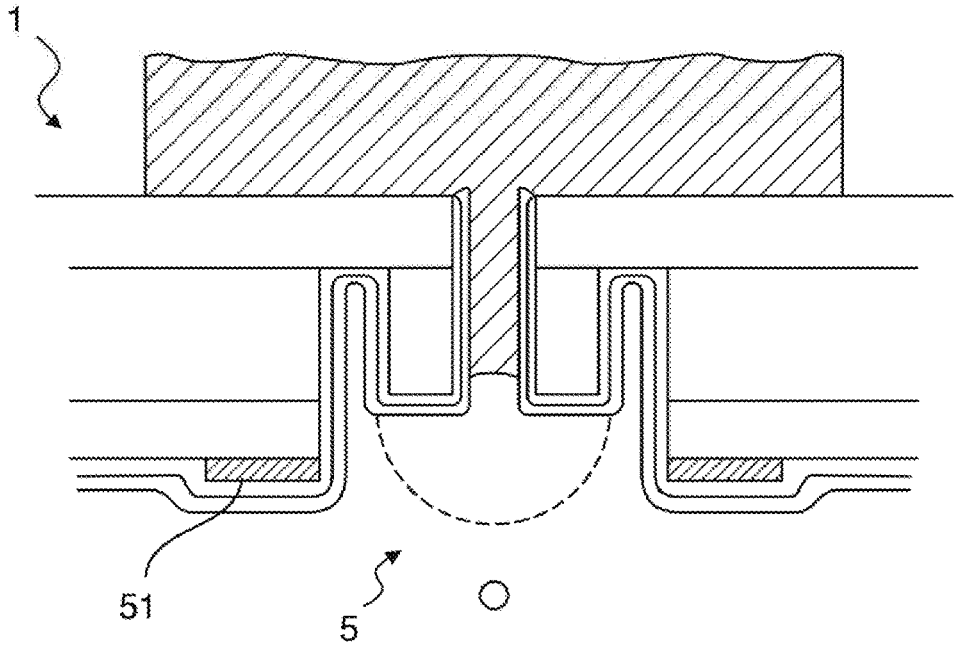
FIG. 2 shows a sectional drawing of a nozzle according to a first embodiment comprised on the print head of FIG. 1 that is associated with one extraction electrode.

FIG. 2 shows a nozzle (5) according to prior art that is operated by an electroyhdrodynamic ejection principle. Ink is ejected from the nozzle (5) by use of a ring-like extraction electrode (51) that is formed at an axial and radial distance from the nozzle (5). The schematically illustrated nozzle (5) is understood as one of the preferred embodiments for implementation into a print head (1) according to the present invention.

Figure 3:
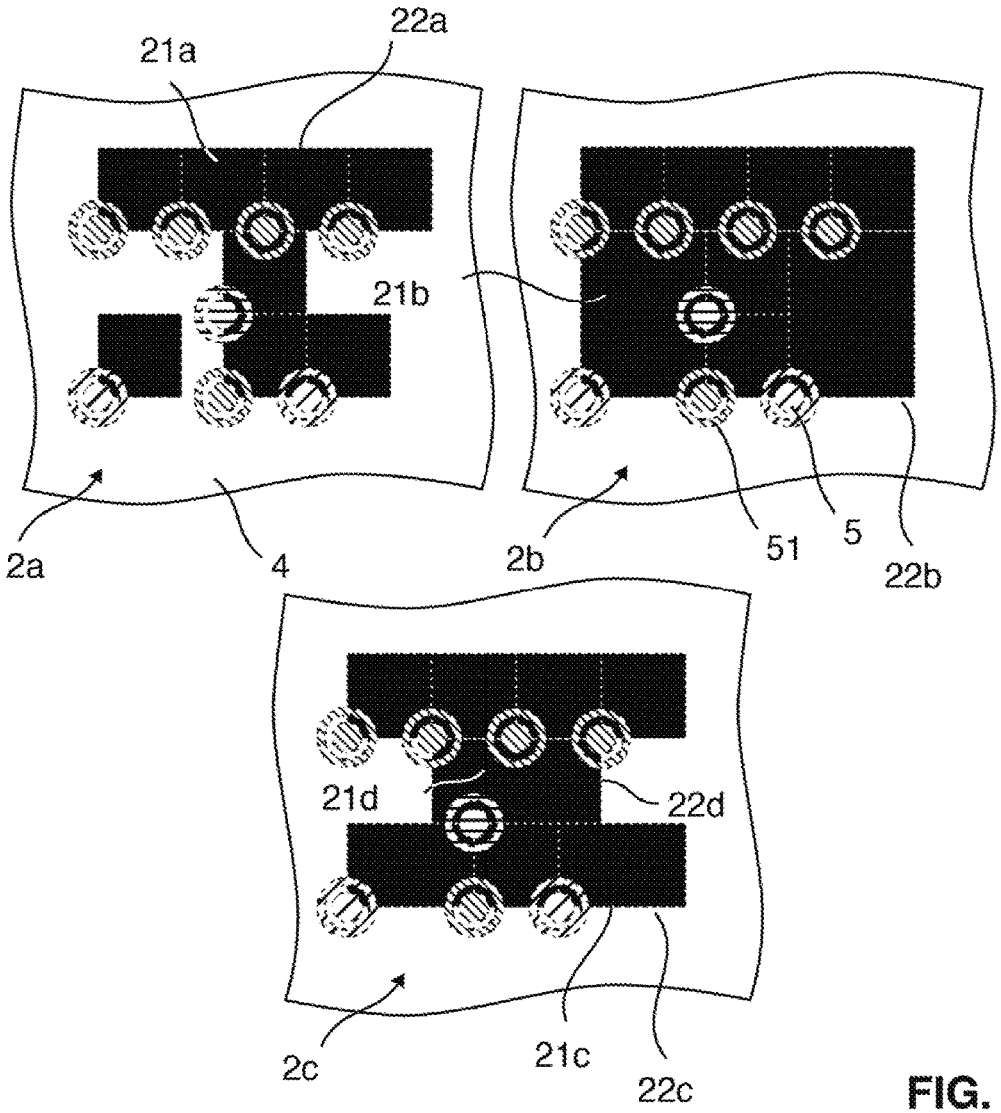
FIG. 3 shows a top view on the substrate containing three print patterns that were printed by the print head.

FIG. 3 shows the top view of a substrate that contains print patterns (2*a*, 2*b*, 2*c*) that were formed by one and the same print head (not shown). The nozzles (5) and extraction electrodes (51) contained on the print head are indicated by dashed circles and are drawn in positional agreement with the reference position of the print head (1) with respect to the substrate (4). It is illustrated how the print pattern (2*a*, 2*b*, 2*c*) is decomposable into a bitmap graphic that solely consists of full pixels and how the different print patterns (2*a*, 2*b*, 2*c*) can be printed by the same print head (1) by variations of said bitmap graphic. The print head provides a fixed arrangement of nozzles (5), the nozzles (5) of which have one extraction electrode (51) that makes a fixed connection to one of three contact points (not shown). The assignment of the nozzles (5) to the respective contact points is highlighted by different fillings of the nozzles (5) and extraction electrodes (51). The boundary of each print pattern segment (21*a*, 21*b*, 21*c*, 21*d*) is indicated by exactly one unit cell (22*a*, 22*b*, 22*c*, 22*d*). Because the printed print pattern segments (21*a*, 21*b*, 21*c*, 21*d*) are formed as a unit pixel, they are equivalent in their size and position to the unit cells (22*a*, 22*b*, 22*c*, 22*d*). Flexibility in the creation of different print patterns (2*a*, 2*b*, 2*c*) can thereby be obtained by adjusting the physical appearance of the print pattern segments (21*a*, 21*b*, 21*c*, 21*d*) directly through modifications of the size and shape of the respective unit cells (22*a*, 22*b*, 22*c*, 22*d*). However, as a boundary conditions, all nozzles (5) that are connected to the same contact point print identical print pattern segments (21*a*, 21*b*, 21*c*, 21*d*). The initial placement of nozzles (5) on the print head, as well as their assignment to the available contact points therefore pose rather strong restrictions on print pattern (2*a*, 2*b*, 2*c*) flexibility. The resolution at which different print patterns (2*a*, 2*b*, 2*c*) can be formed on the basis of unit pixels depends on the distance between the nozzles (5) on the print head, and is also referred to as bitmap resolution.

Figure 4:
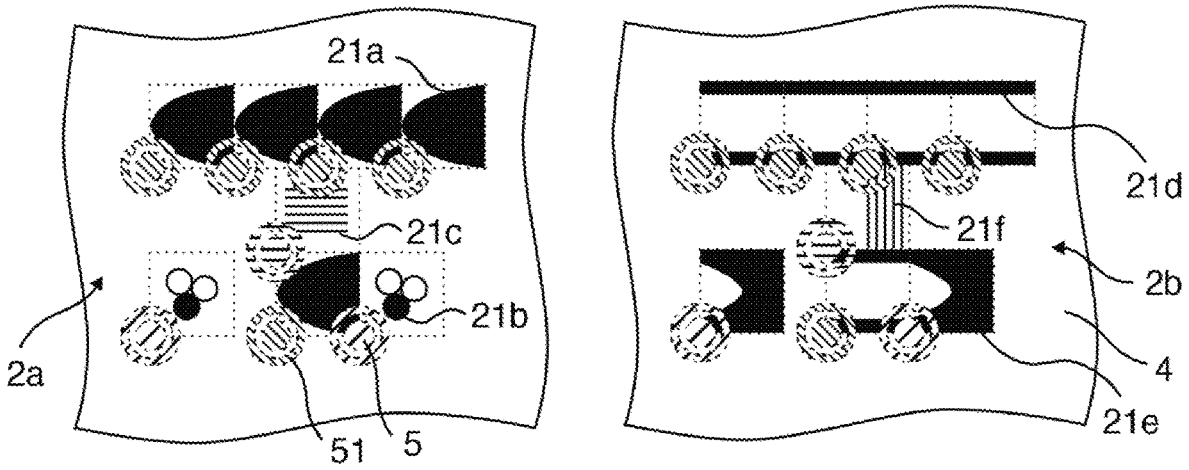
FIG. 4 shows a top view on the substrate containing two print patterns that were printed by the print head.

FIG. 4 shows a top view onto a substrate that contains two print patterns (2*a*, 2*b*) that have been created by the same print head (not shown). The nozzles (5) and extraction electrodes (51) contained on the print head are indicated by dashed circles and are drawn in positional agreement with the reference position of the print head with respect to the substrate (4). The figure illustrates how every print pattern segment (21*a*, 21*b*, 21*c*, 21*d*, 21*e*, 21*f*) essentially contains a variable, complex graphic on its own, instead of a unit pixel. The print pattern segments (21*a*, 21*b*, 21*c*, 21*d*, 21*e*, 21*f*) have been created as a vector graphic by assembling primitive objects that are printed by the individual nozzles (5) of the print head. The appearance of this vector graphic thereby depends the individual printing movement associated the nozzles (5) and their individual triggering sequences, wherein nozzles associated with the same contact point create the same vector graphic. Again, nozzles (5) and extraction electrodes (51) associated with identical contact points are highlighted by identical hatched textures. The resolution of the vector graphic of a single print pattern segment (21*a*, 21*b*, 21*c*, 21*d*, 21*e*, 21*f*) depends on the actual printing resolution, i.e. on the smallest sizes of the primitive objects the print pattern segments (21*a*, 21*b*, 21*c*, 21*d*, 21*e*, 21*f*) are made of.

Figure 5:
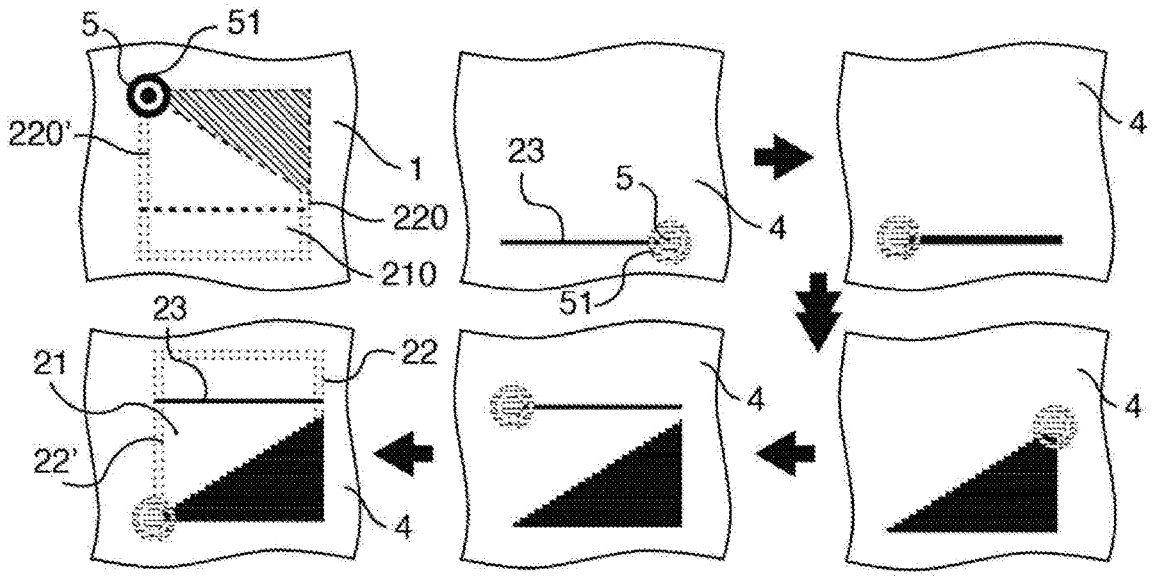
FIG. 5 shows a schematic sketch illustrating the printing of a print pattern segment onto the substrate by a nozzle of the print head seen along a bottom view.

FIG. 5 shows a bottom view onto the area of a print head (1) where a specific nozzle (5) is located. Also shown is the projected print pattern segment (210), as well as the inner unit cell (220') and the outer unit cell (220") associated with this nozzle (5), wherein the nozzle (5) is formed on the print head at the corner of the inner unit cell (220'), said corner being the main corner. The distance between the inner unit cell (220') and the outer unit cell (220") is half the width of the primitive line (23) printed by the nozzle (5), such that the projected print pattern segment (210) is enclosed within the boundary of the outer unit cell (220"). For clarity this distance between the inner unit cell (220') and the outer unit cell (220") is drawn excessively large. In a sequence of steps it is then shown the substrate (4) from the perspective of the print head (1), and it is schematically illustrated how the print head (1) is used to form on the substrate (4) the print pattern segment (21) from primitive lines (23) that have all the same orientation, the orientation being identical to the primary orientation of the unit cells (220', 220"). The position of the print head during the printing movement is highlighted by showing only drawings of the nozzle (5) and extraction electrode (51) while fading out the rest of the print head (1), allowing a view through the print head (1) onto the substrate (4). All steps involves movements that are restricted in their absolute magnitude by the size of the inner unit cell (220') measured from its main corner. The print pattern segment (21) is eventually assembled from the primitive lines (23) that are overlapped along the secondary orientation of the inner unit cell (22'). In the last step the movement between print head (1) and substrate (4) is revoked and it can be seen that the print pattern segment (21) has been created on the substrate (4) in positional and dimensional agreement with the print pattern segment (210) that was projected onto the print head (1) surface.

Figure 6:
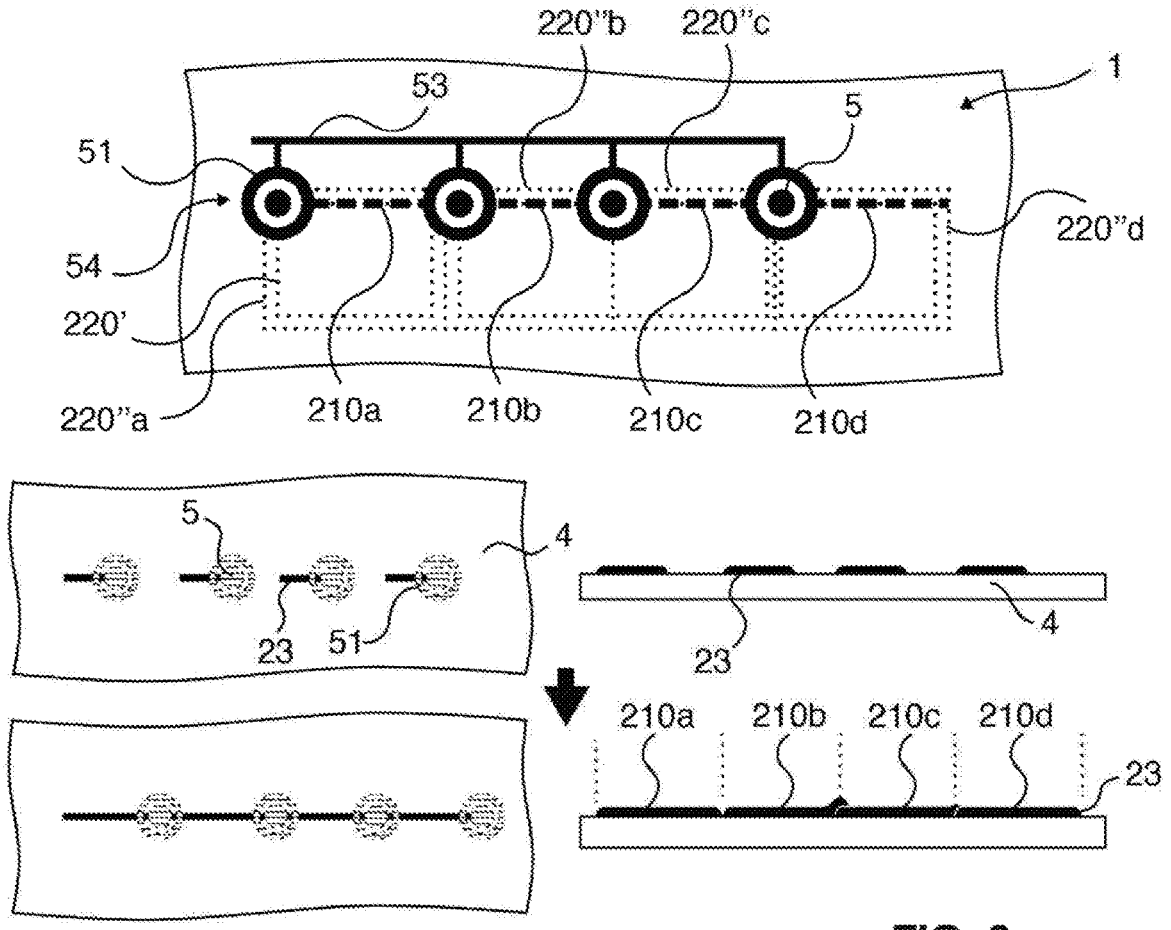
FIG. 6 shows a schematic sketch illustrating the printing of a print pattern onto the substrate by a nozzle row.

FIG. 6 shows first a bottom view onto the area of a print head (1) where a specific nozzle row (54) is located. Also shown are the projected print pattern segments (210*a*, 210*b*, 210*c*, 210*d*), all of which are made of a single primitive line (23), and the inner unit cells (220') and outer unit cells (220"*a*, 220"*b*, 220"*c*, 220"*d*) associated with the respective nozzles (5) of the nozzle row (54). All nozzles (5) are connected to the contact point (not shown) which is illustrated by the fact that the conductive tracks (53) originating from the different extraction electrodes (51) eventually merge with each other. The separation between the nozzles (5) is chosen such that the respective outer unit cells (220"*a*, 220"*b*, 220"*c*, 220"*d*) of two neighboring nozzles (5) are exactly matched at their edges. While all the inner unit cells (220') have the same size, which is a characteristic for a nozzle row (54), the outer unit cells (220"*a*, 220"*b*, 220"*c*, 220"*d*) are chosen with different primary lengths, giving rise to different separation between the nozzles (5) inside the nozzle row (54). Particularly, at every interconnection between two neighboring nozzles (5), different distances between the inner unit cells (220') and the outer unit cells (220"*a*, 220"*b*, 220"*c*, 220"*d*) are realized. The distances vary between zero and half the width of a primitive line (23) that the print patterns (210*a*, 210*b*, 210*c*, 210*d*) are made of (wherein for visual clarity the distance is shown larger than anticipated). In a sequence of two steps it is then schematically illustrated how the print head (1) during a movement along the initial movement direction, prints a single primitive line (23) on the substrate (4) that is made of the four interconnected print pattern segments (21*a*, 21*b*, 21*c*, 21*d*) printed by the nozzles (5), wherein the substrate (4) is shown from a top view as well as in a cross-section at the position of the lines. The position of the print head (1) during the printing movement is highlighted by showing only drawings of the demagnified nozzles (5) and extraction electrodes (51) while fading out the rest of the print head (1), allowing a view through the print head (1) onto the substrate (4). It is shown that by aligning the printing movement direction with the alignment direction of the nozzle row (54), the individual primitive lines (23) of two neighboring nozzles (5) eventually connect and may even overlap, depending on the exact separation between said two nozzles (5), i.e. on the size of the respective outer unit cells (22"*a*, 22"*b*, 22"*c*, 22"*d*). It is shown that the endings of a primitive line (23) are generally rounded, such that the connection between two individual primitive lines (23) involves an overlap that can locally create an inhomogeneous topography of the merged primitive lines (23). At the interconnection where the inner unit cell (22') is separated from the outer unit cell (22"*a*, 22"*b*) by half the width of the primitive line (23), the two print pattern segments just make contact but do not overlap. At the interconnection where the inner unit cell (22') is not separated from the outer unit cell (22"*b*, 22"*c*), the two respective print pattern segments strongly overlap with each other, giving rise to a interconnect region that is twice as thick as the rest of the primitive line (23). At the last interconnection, where the inner unit cell (22') is separated from the outer unit cell (22"*c*, 22"*d*) by 0.25 times the width of the primitive line (23) there is formed a topographically much smoother interconnection than for the other two scenarios. For providing clarity on the formation of the final primitive line (23) from its individual print pattern segments (21*a*, 21*b*, 21*c*, 21*d*) there is also indicated in the cross-section the boundary of the outer unit cells (22"*a*, 22"*b*, 22"*c*, 22"*d*) by dashed lines. Importantly, it is shown that a proper interconnection actually requires two neighboring nozzles (5) to print minimum amounts of material onto the print pattern segment (21*a*, 21*b*, 21*c*, 21*d*) assigned to the respective other nozzle.

Figure 7:
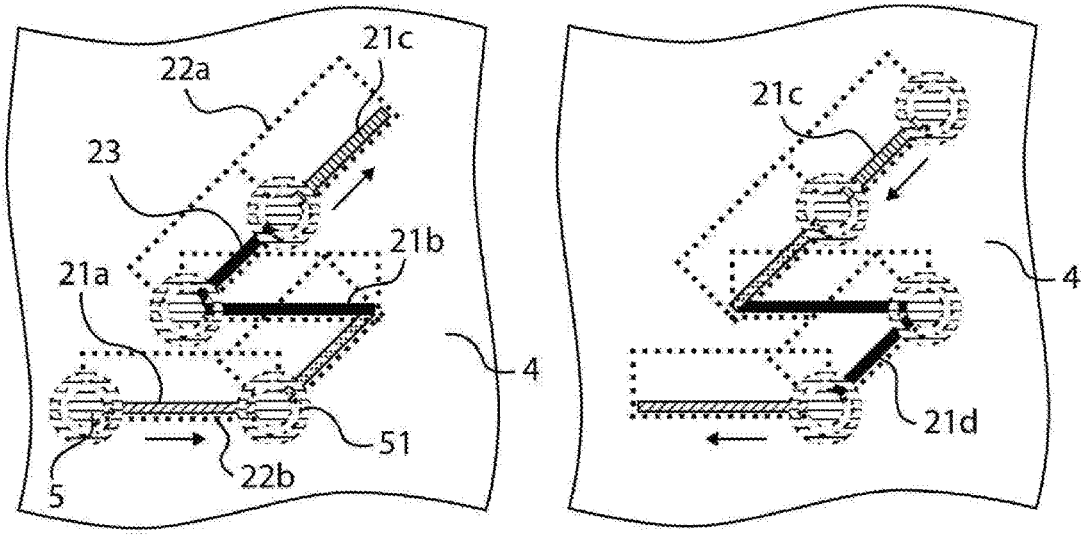
FIG. 7 shows a schematic sketch illustrating the printing of a print pattern onto the substrate by a nozzle arranged on the print head along two different orientations seen along the top view.

FIG. 7 illustrates a more complex arrangement of print pattern segments (21*a*, 21*b*, 21*c*, 21*d*), including such print pattern segments (21*b*, 21*d*) that consist of more than one unit cell (22*a*, 22*b*). For visual clarity, the inner boundary of the unit cells is not drawn in the figure. Unit cells (22*a*, 22*b*) have the purpose of indicating preferable movement directions and magnitudes, wherein the primary unit cell orientations is incident with the orientation of primitive lines (23) that are associated to the different unit cells (22*a*, 22*b*). Here, it is shown the substrate (4) from above, the substrate (4) containing print pattern segments (21*a*, 21*b*, 21*c*, 21*d*) that have been printed by a print head (not shown). The position of the print head at its reference position is illustrated by dashed drawings of its nozzles (5) as they are placed above the substrate (4). It is formed a line with a zig zag structure that obtains two sharp angles between the primitive lines (23) of neighboring print pattern segments (21*b*, 21*c*, 21*d*). However, all print pattern segments (21*a*, 21*b*, 21*c*, 21*d*) are formed from primitive lines (23) of only two different orientations. Therefore, there are defined unit cells (22*a*, 22*b*) of two different orientation. In order to allow efficient printing with a minimum of movements, the nozzles (5) of identical unit cells (22*a*, 22*b*) have been placed at the same corner of said unit cells (22*a*, 22*b*). As shown, this can be fulfilled by two different nozzle (5) arrangements. None of the two nozzle (5) arrangements is superior with respect to the other, they only differ in the direction of the initial movement direction which is indicated by arrows for the two differently oriented unit cells (22*a*, 22*b*). While the print pattern segments (21*a*, 21*c*) assigned to three of the four nozzles (5) consist of a single primitive line (23), one nozzle (5) necessarily prints a print pattern segment (21*b*, 21*d*) that consists of two primitive lines (23) having different orientation and hence the respective print pattern segment (21*b*, 21*d*) is outlined by two differently oriented unit cells (22*a*, 22*b*). The assignment of the different primitive lines (23) to a print pattern segment (21*a*, 21*b*, 21*c*, 21*d*) is indicated by different textures in the schematics.

Figure 8:
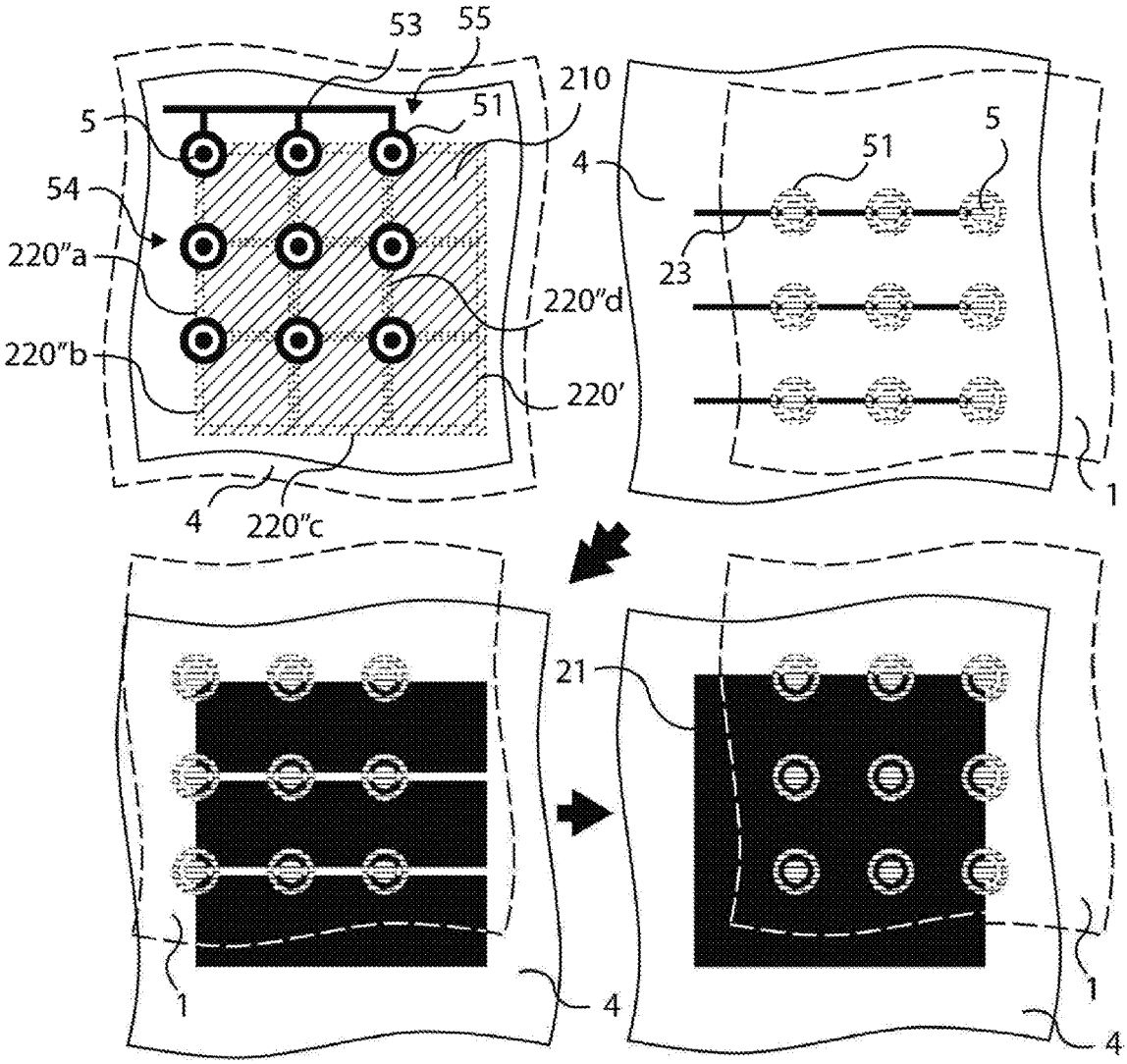
FIG. 8 shows a schematic sketch illustrating the printing of a patch onto the substrate by a nozzle array.

FIG. 8 schematically illustrates the steps of cooperatively forming a large patch by a nozzle array (55). First shown is the surface of a print head (1) seen from the direction of the substrate (4), wherein the position of the underlying substrate (4) is indicated with a dashed boundary. Nozzles (5) are arranged in three nozzle rows (54) which integrate into a nozzle array (55). All nozzles (5) are contacted to the same contact point (not shown), and hence print their print pattern segments (210) with identical individual printing movements and triggering sequences. Also shown on the print head (1) are the inner unit cells (220') and the outer unit cells (220"*a*, 220"*b*, 220"*c*, 220"*d*). All inner unit cells (220') of the nozzle array (55) have the same size and orientation. At the edges of the nozzle array (55), the respective inner unit cell (220') is separated from the outer unit cell (220"*a*, 220"*b*, 220"*c*, 220"*d*) by half the width of the primitive line (23) printed by the nozzles (5). In order to allow a smooth interconnection between the primitive lines (23) of neighboring unit cells along both unit cell orientation, wherever an interconnection is formed between two neighboring nozzles (5), the distance between the inner unit cell (220') and the outer unit cell (220"*a*, 220"*b*, 220"*c*, 220"*d*) is reduced to a value that is smaller than 0.5 times the width of the primitive line (23). Please note that for visual clarity the distances between inner unit cell (220') and outer unit cell (220"*a*, 220"*b*, 220"*c*, 220"*d*) have been drawn exaggeratedly. The nozzles (5) are formed at the location of the main corner of their respective inner unit cells (220'), wherein the distance between any two neighboring nozzles (5) is essentially given by their outer unit cell (220"*a*, 220"*b*, 220"*c*, 220"*d*) which are matched to at their corresponding edges. All print pattern segments (210) are formed as full pixels from overlapping primitive lines (23). The formation of the large patch by the nozzle array (55) is illustrated in a sequence of three steps, wherein the course of the formation of the print pattern segments (210) on the substrate (4) is shown from the direction of the print head (1), the print head (1) being partly faded out. First, the nozzles (5) of all three nozzle rows (54) cooperatively create one line. In a second step this procedure is repeated several times while offsetting along the secondary unit cell orientation until the patches formed by the individual nozzle rows (54) are only separated by a fine gap that is smaller than the width of a single primitive line (23). Eventually, this gap is closed in a third step by printing a last primitive line (23) to the position where the gap is located.

Figure 9:
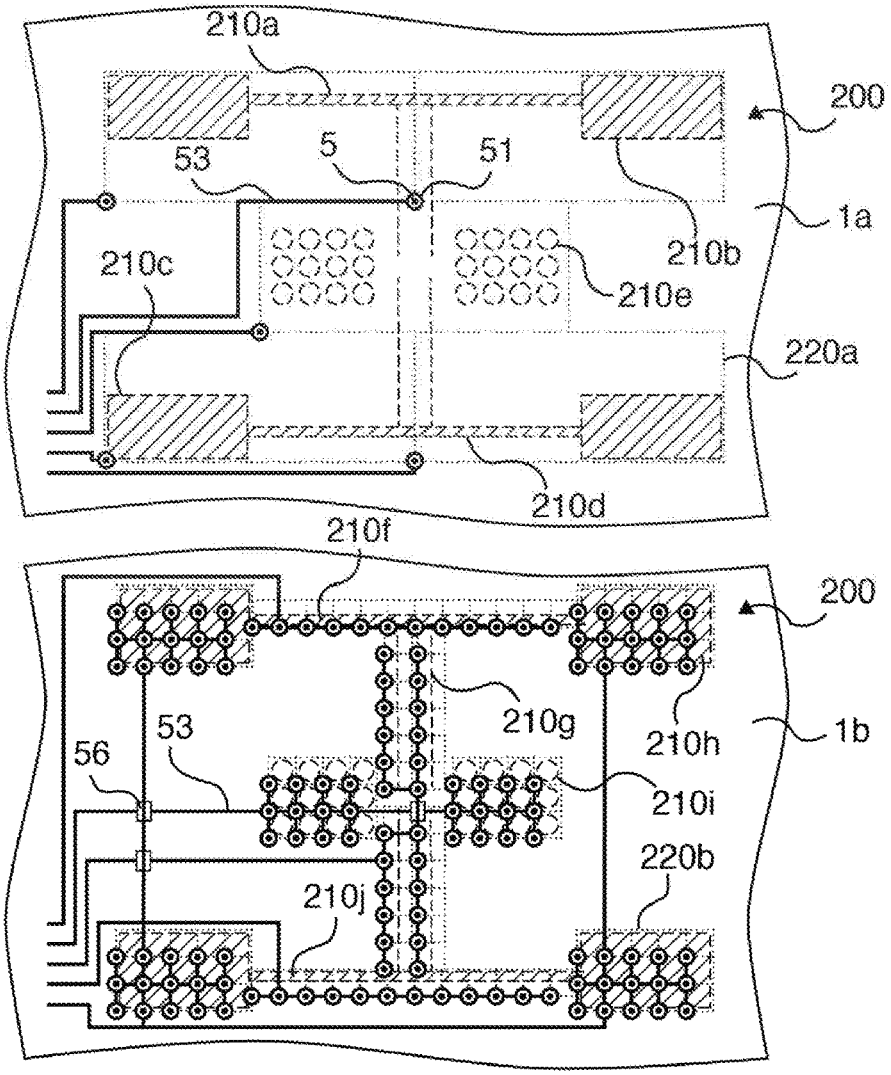
FIG. 9 shows a bottom view onto the surfaces of two print heads comprising nozzles arranged according to a first embodiment (upper part) and a second embodiment (lower part)

FIG. 9 shows the bottom surface of two print heads (1*a*, 1*b*) that have been formed to satisfy the requirements of an identical print pattern (200) that is projected onto the print head (1*a*, 1*b*) surface. Both print heads (1*a*, 1*b*) can be operated with a maximum of five contact points (not shown), thereby restricting the number of unique print pattern segments (210*a*, 210*b*, 210*c*, 210*d*, 210*e*, 210*f*, 210*g*, 210*h*, 210I, 210*j*) that the print pattern (200) can be decomposed to. The first print head (1*a*) only comprises five nozzles (5) all of which are assigned to a different print pattern segment (210*a*, 210*b*, 210*c*, 210*d*, 210*e*) and to another contact point, wherein the unit cells (220*a*) associated with the five nozzles (5) span equally large areas. The second print head (1*b*) comprises a much larger number of nozzles (5), many of which are assigned to a common contact point, which is illustrated by five separate conductive tracks (53) that contact to multiple extraction electrodes (51). The conductive tracks (53) reaching to different contact points have to be electrically insulated from each other which requires for formation of insulating nodes (56) at the crossing points. Print pattern segments (210*f*, 210*g*, 210*h*, 210I, 210*j*) are formed such that a large density of nozzles (5) can be created on the print head (1*b*). Essentially the print pattern (200) is decomposed into the smallest possible print pattern segments (210*f*, 210*g*, 210*h*, 210I, 210*j*) the still comply with the minimum attainable separation between two nozzles (5), the minimum separation being indicated by the size of the unit cells (220*b*). The formation of the print pattern segments (210*f*, 210*g*, 210*h*, 210I, 210*j*) is further influenced by forming the unit cells (220*b*) around parts of the print pattern (200) that can be printed by identical individual printing movement and triggering sequences. Due to the larger density of nozzles (5) that is employed with the second print head (1*b*), this print head (1*b*) concludes printing of the print pattern (200) much faster than the first print head (1*a*), in fact printing of the print pattern (200) concludes approximately 55 times faster with the second print head (1*b*), even though it only uses 26 times more nozzles (5). The difference in printing time is understood by the difference in the area of the unit cells of the This is possible due to the fact that nozzles (5) are only placed where they are actually required. However, when it comes to flexibility, the first print head (1*a*) is vastly superior compared to the second print head (1*b*). Because every nozzle (5) on the first print head (1*a*) is individually addressable, this first print head (1*a*) can print in a fully flexible manner, while the design variability of the second print head (1*b*) is strongly restricted by the position of nozzles (5) of simultaneously addressed nozzles.

Figure 10:
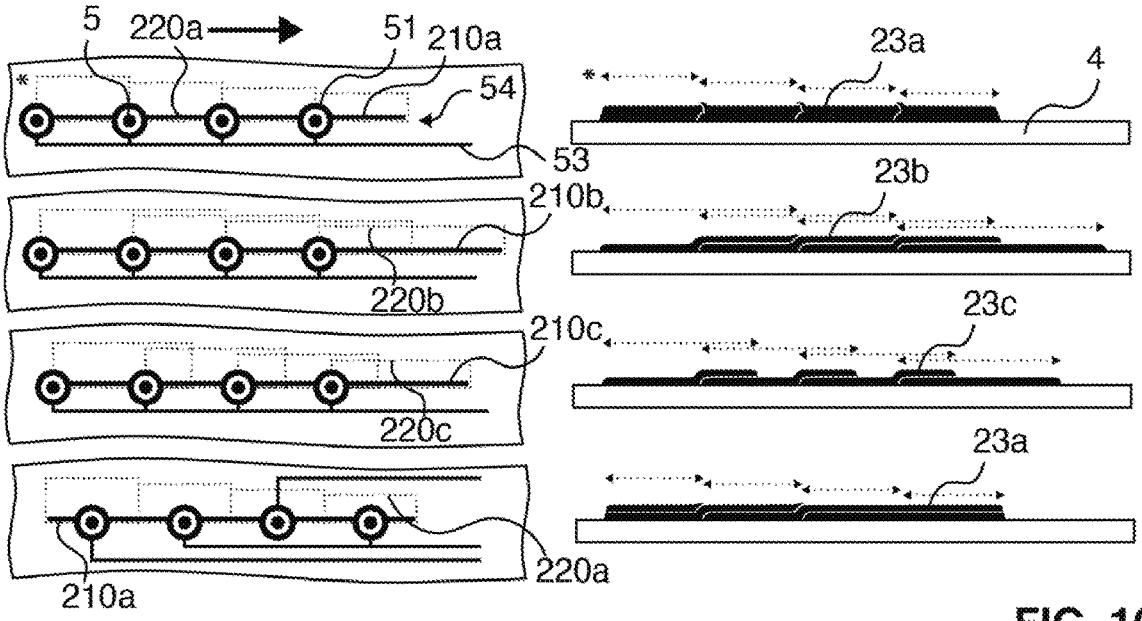
FIG. 10 shows a top view onto the surface of a print head comprising different arrangements of nozzles (left side) printing different print pattern segments onto a substrate (right side)
Figure 11:
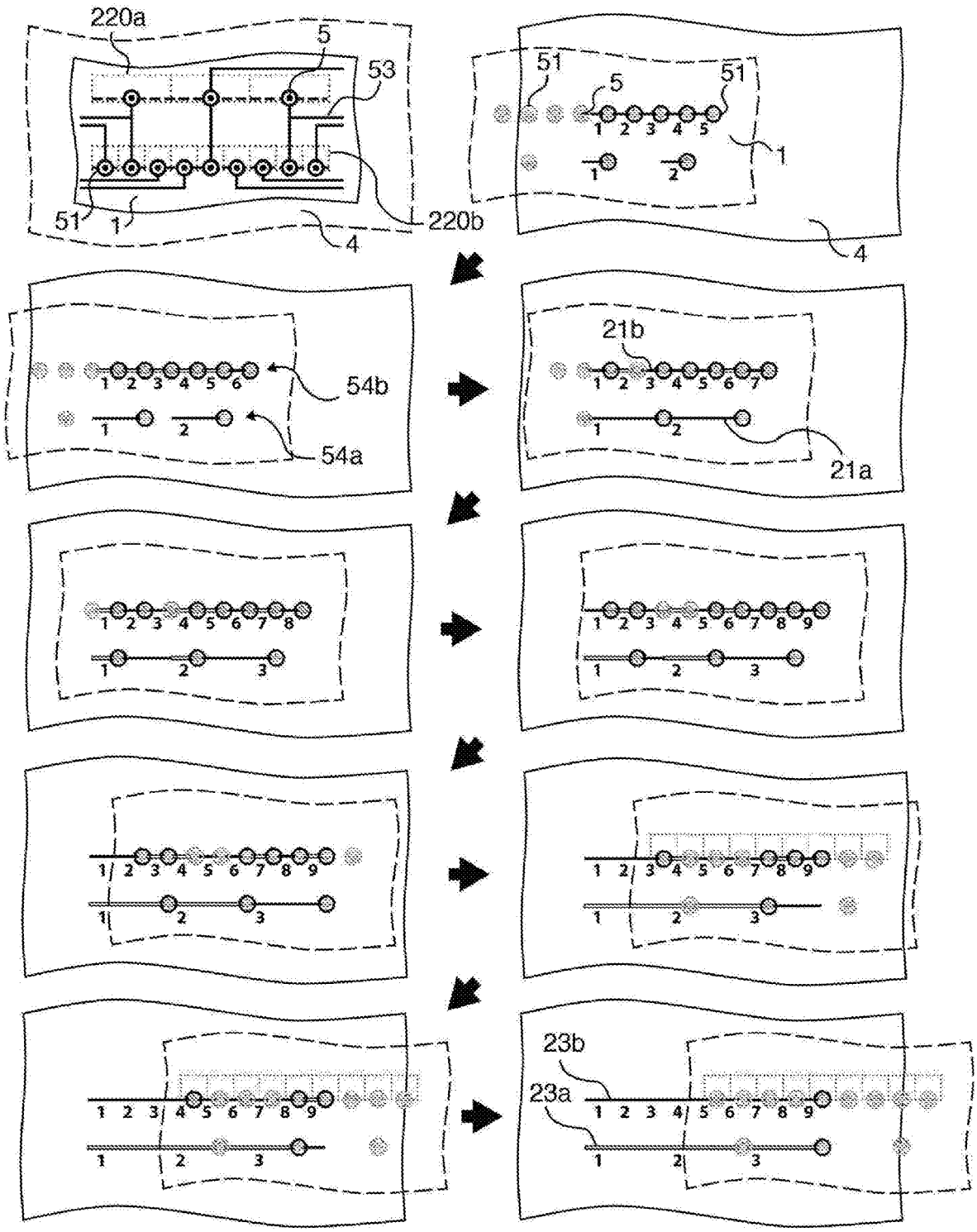
FIG. 11 shows the surface of a print head seen from below through a transparent substrate (upper left side) and a schematic sketch illustrating the printing of a print pattern onto the substrate by two nozzle rows arranged on the surface of said print head according to a first embodiment.

FIG. 10 shows how a physically identical arrangement of nozzles (5) can be differently controlled in order to create physically different print pattern segments (210*a*, 210*b*, 210*c*) and how such execution is indicated by the choice of unit cells (220*a*, 220*b*, 220*c*). For simplicity, the formation of an inner unit cell has been omitted, meaning that the unit cells (220*a*, 220*b*, 220*c*) are representative for both, the inner and outer boundary. Four examples are shown, for each of which there is schematically illustrated the surface of a print head (1) with a nozzle row (54) consisting of four nozzles (5). Also shown are the respective extraction electrodes (51) and the conductive tracks (53) that are used to make connection to at least one contact point (not shown). Next to the print head (1) there is shown a cross-section of the substrate (4) along the single primitive line (23*a*, 23*b*, 23*c*) that originates as combination of the print pattern segments (210*a*, 210*b*, 210*c*) assigned to the four nozzles (5). The primitive line (23*a*, 23*b*, 23*c*) is made of material that has been deposited by the four nozzles (5), wherein the deposits of different nozzles (5) are visually separated from each other by fine white lines. Unit cells (220*a*, 220*b*, 220*c*) are projected onto the print head (1) but are also indicated in the cross-section by dashed arrows. A star is employed to clearly highlight the orientation of the different drawings. In the first example (top), the print pattern segments (210*a*) have been formed by first moving the print head (1) along the indicated direction (large arrow) by one step equal in length to the primary length of the unit cells (220*b*), and backward to its reference position by an equally long second step, while continuously printing. The primitive line (23*a*) becomes doubled in its thickness during the second half-cycle. In the second example, the print head (1) moves by the same magnitude, but by performing an additional step in forward direction instead of a backward movement. Because the nozzles (5) are always activated during printing, the resulting primitive line (23*b*) becomes longer than that of the first example, wherein the primitive line (23*b*) further obtains a non-uniform thickness profile. The thickness inhomogeneity is restricted to two regions, the center region of the primitive line (23*b*) which contains two primitive line layers and the endings of the primitive line (23*b*) which only contain one primitive line layer. Due to the primitive line (23*b*) being longer, the unit cells (220*b*) are also drawn larger and effectively overlap with each other, such that the print pattern segments (210*b*) of neighboring nozzles are partly printed to the same position. In the third example, the unit cells (220*c*) of the different print pattern segments (210*c*) still overlap with each other but the printing movement is only 1.5 steps in forward direction. The resulting primitive line (23*c*) therefore attains a length that is intermediate as compared to the first two examples. Furthermore, the primitive line (23*c*) now obtains a periodically non-uniform thickness. In the last example (bottom), redundant overprinting is demonstrated, where the print head (1) is moved by a longer forward distance than suggested by the length of the respective unit cells (220*a*). Here, the print head (1) is even moved by three steps in forward direction (the exact procedure is illustrated in FIG. 11) while the intended length of the primitive line (23*a*) is controlled by selective triggering of the different nozzles (5) by the use of three different contact points (not shown). The print pattern segments (210*a*) are identical to those of the first example. However, each print pattern segment (210*a*) is now printed to equal parts by two nozzles instead of only one. Furthermore, the primitive line (23*a*) is formed with lesser inhomogeneity at overlapping points between the print pattern segments assigned (210*a*) to neighboring nozzles (5). In comparison to all other examples, the nozzles (5) in the last example are formed at the center of an edge of the unit cell (220*a*) and not at one of the corners of the unit cell (220*a*).

FIG. 11 shows first the surface of a print head (1) from below through a transparent substrate (4), wherein the position of the substrate (4) is indicated by a dashed boundary. On the print head surface there are shown two nozzle rows (54*a*, 54*b*) that employ different unit cells (220*a*, 220*b*)

and hence different nozzle (5) separation along the alignment direction of the nozzle rows (54*a*, 54*b*). For simplicity, the unit cell (220*a*, 220*b*) is drawn representative for both of the respective unit cell boundaries. The smaller unit cell (220*b*) is exactly three times smaller than the larger unit cell (220*a*). Nozzles (5) are formed at the center of a common edge of the respective unit cells (220*a*, 220*b*) and the extraction electrodes (51) of the nozzles (5) are contacted by conductive tracks (53) to the contact points (not shown). All extraction electrodes (51) associated with the smaller unit cells (220*b*) are connected to a separate contact point. The extraction electrodes (51) associated with the larger unit cells (220*a*) use particular contact points that are already employed by an extraction electrode (51) associated with one of the smaller unit cells (220*b*). In the next drawings it is then schematically illustrated how redundant overprinting can be employed to simultaneously print the equally long primitive lines (23*a*, 23*b*) with each nozzle row (54*a*, 54*b*), wherein it is shown the substrate (4) from above through the partly faded print head (1). In a first step the print head (1) perform a leftward shifting movement away from its reference position by a distance that is equal to half the movement distance that is used during subsequent printing, i.e. by 1.5 times the size of the larger unit cells (220*a*). The print head (1) is shown after being printed with during a movement from the shifted position by a distance that is equal to one time the width of the smaller unit cells (220*b*). With every further step the print head (1) then moves the same distance one more time until the total movement distance becomes nine times the width of the smaller unit cells (220*b*). At the end of every movement step some nozzles (5) are activated/deactivated as required. Which nozzles (5) have been activated during a movement step is indicated by a black filling of the activated extraction electrodes (51). In the course of the printing movement one nozzle row (54*b*) creates the primitive line (23*b*) with five layers while the other nozzle row (54*a*) simultaneously creates the same primitive line (23*a*) with only two layers. The number of primitive line layers created is equal to $0.5\cdot(x+1)$, wherein x is the total distance during printing in integer numbers of the width of the respective unit cells (220*a*, 220*b*). To distinguish the thickness of a print pattern segment (21*a*, 21*b*) during printing, every second layer of the primitive line segment associated with the respective print pattern segment (21*a*, 21*b*) is drawn with a white filling. For visual clarity, numbers have been added to the schematic that indicate the different print pattern segments (21*a*, 21*b*) as they are assigned to the nozzles (5) along the movement direction.

Figure 12:
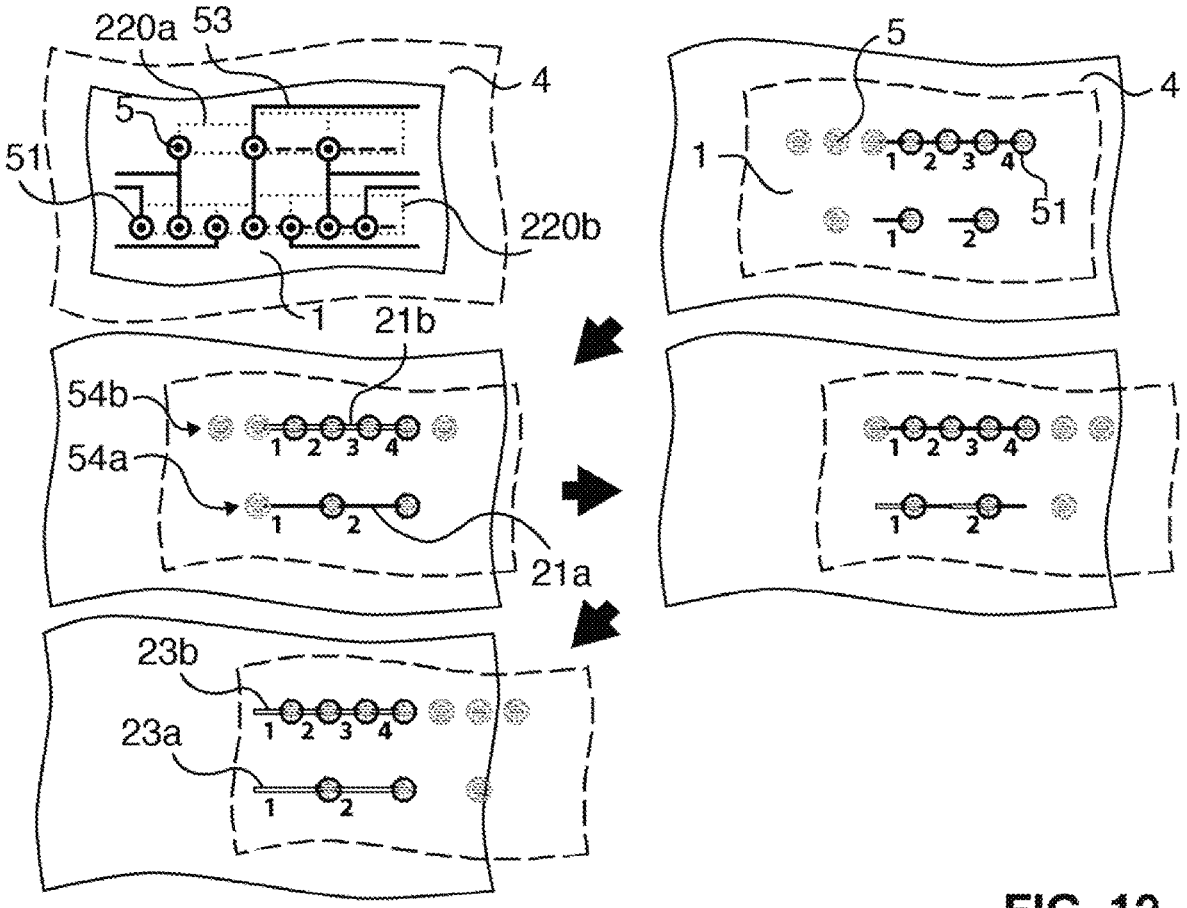
FIG. 12 shows the surface of a print head seen from below through a transparent substrate (upper left side) and a schematic sketch illustrating the printing of a print pattern onto the substrate by two nozzle rows arranged on the surface of said print head according to a second embodiment.

FIG. 12 shows first the surface of a print head (1) from below through a transparent substrate (4), wherein the position of the substrate (4) is indicated by a dashed boundary. On the print head surface there are shown two nozzles rows (54*a*, 54*b*) that employ differently sized unit cells (220*a*, 220*b*) and hence different nozzle separation along the direction of the nozzle rows (54*a*, 54*b*). The smaller unit cell (220*b*) is exactly two times smaller than the larger unit cell (220*a*). For simplicity, the unit cell (220*a*, 220*b*) is drawn representative for both of the respective unit cell boundaries. Nozzles (5) are formed at main corner of their unit cells (220*a*, 220*b*) and the extraction electrodes (51) of the nozzles (5) are contacted by conductive tracks (53) to the contact points (not shown). All extraction electrodes (51) associated with the smaller unit cells (220*b*) are connected to a separate contact point. The extraction electrodes (51) associated with the larger unit cells (220*a*) use particular contact points that are already employed by one of the extraction electrodes (51) associated with the smaller unit cells (220*b*). Each nozzle row (54*a*, 54*b*) contains at least one nozzle (5) that is associated with an empty unit cell (220*a*, 220*b*), i.e. there is no print pattern segment defined inside the respective unit cell (220*a*, 220*b*). To further distinguish these nozzles (5), the empty unit cells (220*a*, 220*b*) are drawn with a smaller height than the unit cells (220*a*, 220*b*) that are not empty (while conceptually they are identical and are hence equally labeled). Nozzles (5) associated with empty unit cells (220*a*, 220*b*) support the printing of at least one print pattern segment (21*a*, 21*b*). All supporting nozzles (5) are formed on the same side of the nozzle rows (54*a*, 54*b*). In the next drawings it is schematically illustrated how redundant overprinting can be employed to simultaneously print two equally long primitive lines (23*a*, 23*b*) with the two nozzle rows (54*a*, 54*b*), wherein it is shown the substrate (4) from above through the partly faded print head (1). Without any initial shifting movement, the print head (1) immediately initiates printing, wherein each step of the sequence illustrates a movement of the print head (1) by a distance that is equivalent to the width of the smaller unit cells (220*b*). The total movement distance is equal to four times the width of the smaller unit cells (220*b*). At the end every movement step nozzles (5) are activated/deactivated as required. Which nozzles (5) have been activated during a movement step is indicated by a black filling of the activated extraction electrodes (51). In the course of the printing movement one nozzle row (54*b*) creates a primitive line (23*b*) with four layers while the other nozzle row (54*a*) simultaneously creates a primitive line (23*a*) that is equally long but which is only made of two layers. Hence, the number of primitive line layers is equal to x, wherein x is the total distance moved during printing in integer numbers of the width of the respective unit cells (220*a*, 220*b*). To distinguish the actual thickness of every segment of the primitive lines (23*a*, 23*b*) during printing, every second primitive line layer is drawn with a white filling. For visual clarity, numbers have been added to the schematic that indicate the different print pattern segments (21*a*, 21*b*) as they are assigned to the nozzles (5) along the movement direction.

Figure 13:
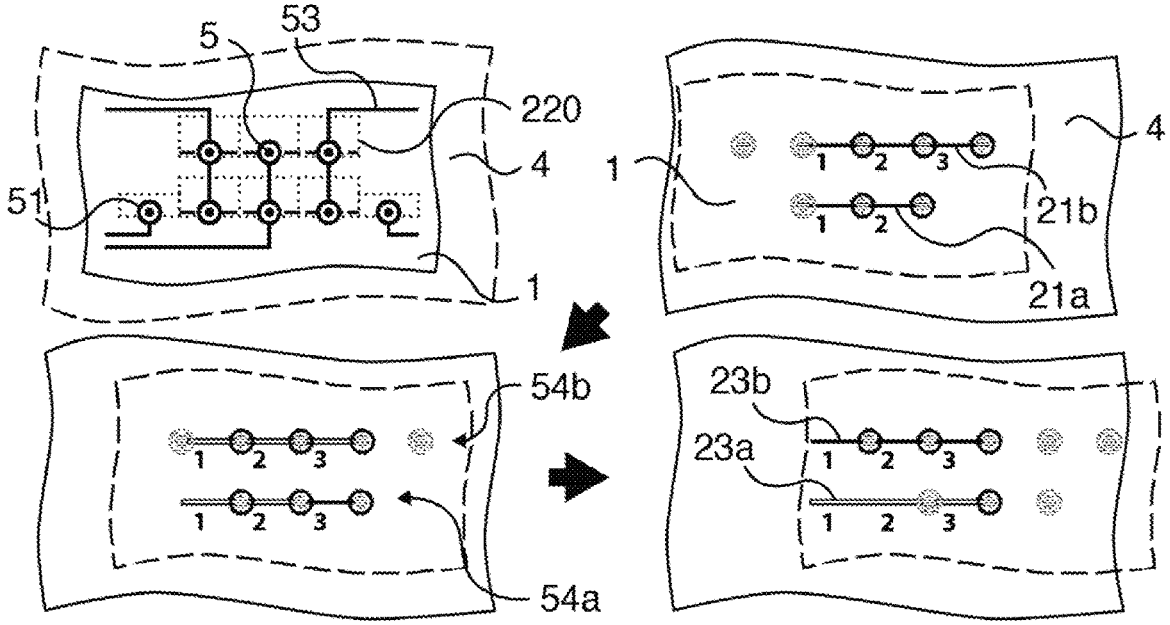
FIG. 13 shows the surface of a print head seen from below through a transparent substrate (upper left side) and a schematic sketch illustrating the printing of a print pattern onto the substrate by two nozzle rows arranged on the surface of said print head according to a third embodiment.

FIG. 13 shows first the surface of a print head (1) from below through a transparent substrate (4), wherein the position of the substrate (4) is indicated by a dashed boundary. On the print head surface there are shown two nozzles rows (54*a*, 54*b*) that employ equally sized unit cells (220), but wherein one of the nozzle rows (54*b*) additionally employs two supporting nozzles (5) with empty unit cells (220), wherein one supporting nozzle (5) is arranged at either end of the nozzle row (54*b*). To distinguish supporting nozzles (5), their unit cells (220) are drawn with a smaller height than the unit cells (220) that are not empty (while conceptually they are identical and hence are equally labeled). All nozzles (5) are arranged at the center of a common edge of the respective unit cells (220). For simplicity, the unit cell (220) is drawn representative for both of the respective unit cell boundaries. The extraction electrodes (51) of the nozzles (5) are contacted by conductive tracks (53) to the contact points (not shown). Each nozzle (5) of the nozzle row (54*a*, 54*b*), including supporting nozzles (5), is associated to an individual contact point, but the contact points can be partly shared between the two nozzle rows (54*a*, 54*b*). In the next drawings it is schematically illustrated how redundant overprinting can be employed to simultaneously print one primitive line (23*a*, 23*b*) with each nozzle row (54*a*, 54*b*), independent of whether supporting nozzles (5) are used or not, wherein it is shown the substrate (4) from above through the partly faded print head (1). In a first step the print head (1) is moved leftwards by a shifting movement away from its reference position, by a distance that is equal to half the movement distance that is used during subsequent printing, i.e. by 1.5 times the width of the unit cells (220). The print head (1) is shown after being printed with during a movement from the shifted position by a distance that is equal to one time the width of the unit cells (220). With every further step of the sequence the print head (1) then moves the same distance one more time until the total movement distance becomes three times the width of the unit cells (220). During every movement step some nozzles (5) are activated/deactivated as required. Which nozzles (5) have been activated during a movement step is indicated by a black filling of the activated extraction electrodes (51). In the course of the printing movement one nozzle row (54*b*) creates a primitive line (23*b*) with three layers while the other nozzle row (54*a*) simultaneously creates a primitive line (23*a*) with only two layers. This exemplifies that the use of supporting nozzles (5) allows a higher printing throughput. To distinguish the actual thickness of every segment of the primitive lines (23*a*, 23*b*) during printing, every second primitive line layer is drawn with a white filling. For visual clarity, numbers have been added to the schematic that indicate the different print pattern segments (21*a*, 21*b*) as they are assigned to the nozzles (5) along the movement direction.

Figure 14:
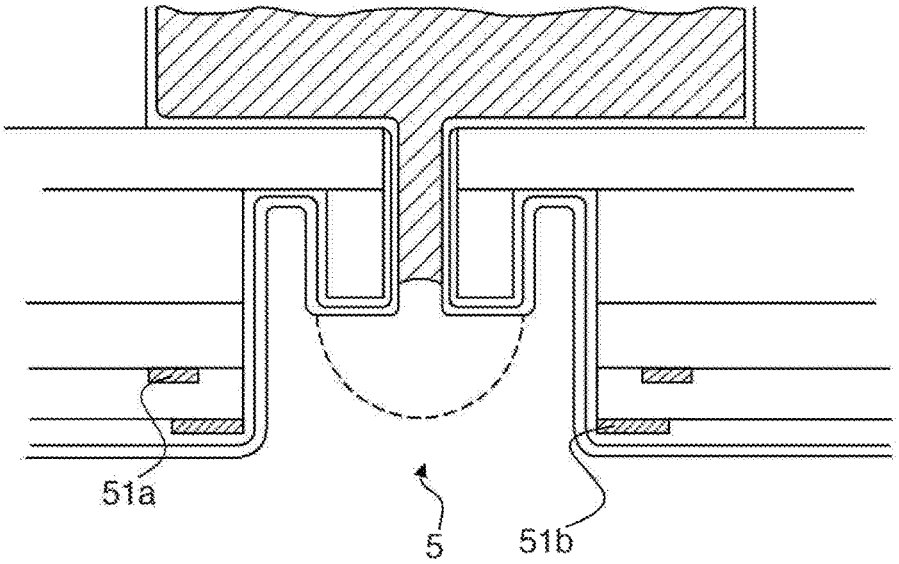
FIG. 14 shows a sectional drawing of a nozzle according to a second embodiment comprised on a print head that is associated with two extraction electrodes.

FIG. 14 shows a schematic illustration of a microfabricated nozzle that employs two extraction electrodes (51*a*, 51*b*). In the figure each extraction electrode (51*a*, 51*b*) is formed on a different insulator layer, wherein the extraction electrode (51*b*) that is axially further away from the nozzle (5) is formed with a smaller inner radius than the other extraction electrode (51*a*). Therefore, the distance between each extraction electrode (51*a*, 51*b*) and the nozzle (5) is approximately identical.

Figure 15:
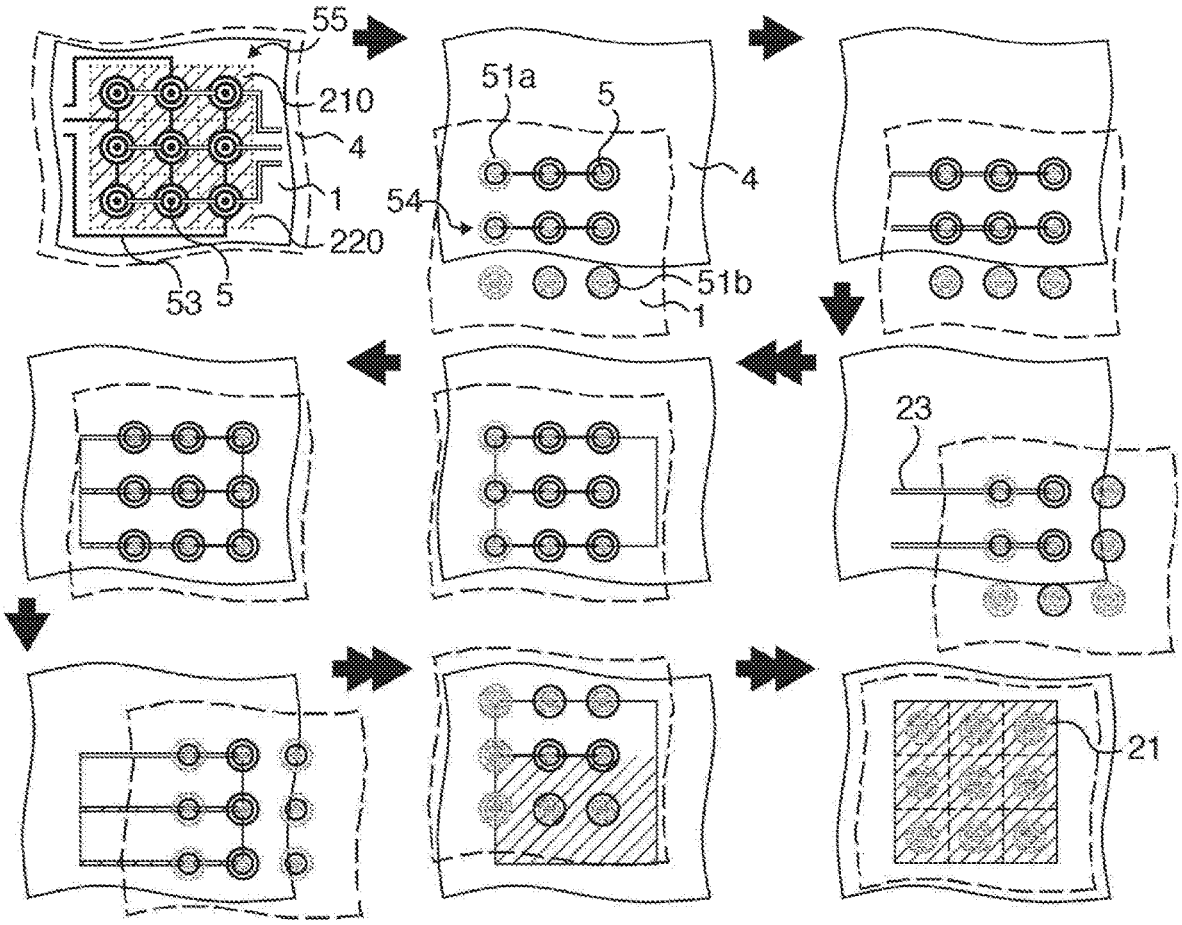
FIG. 15 shows a schematic sketch illustrating the printing of a print pattern onto a substrate by a print head comprising an arrangement of nozzles according to FIG. 14.

FIG. 15 illustrates how a print head (1) with nozzles (5) having two extraction electrodes (51*a*, 51*b*) can be employed for redundant overprinting along both major unit cell (220) orientations. It is first shown a print head (1) seen through a transparent substrate (4), wherein the position of the substrate (4) is highlighted by a dashed boundary. The print head (1) contains nine nozzles (5) which are arranged into three nozzle rows (54), the nozzle rows (54) being part of a nozzle array (55) and are contained in equally sized unit cells (220). For simplicity, the unit cell (220) is drawn representative for both of the respective unit cell boundaries. The two extraction electrodes (51*a*, 51*b*) of every nozzle (5) are contacted by a conductive track (53) to a separate contact point (not shown). For visual clarity, conductive tracks (53) being contacted to the inner extraction electrode (51*b*) are drawn with a white filling. The inner extraction electrodes (51*b*) of all nozzles (5) being part of the same nozzle row (54) are thereby contacted to the same contact point. At the same time, nozzles (5) that are vertically aligned to each other have their outer extraction electrode (54*a*) also contacted to the same contact point. All nozzles (5) are formed at the center of their respective unit cell (220), wherein a nozzle (5) will only print if both of its extraction electrodes (51*a*, 51*b*) are activated. In the next drawings it is shown the substrate (4) through the partly faded print head (1), wherein a sequence of steps illustrates how to form several patch layers of a cooperatively printed patch by redundant overprinting. In a first step the print head (1) is moved by a shifting movement leftwards and downwards, away from its reference position, by a distance that is equal to half the movement distance that is used during subsequent printing into the respective unit cell orientation, i.e. by 1.5 times the primary and secondary length of the unit cells (220), respectively. The print head (1) is shown after being printed with during a rightwards movement from the shifted position, by a distance that is equal to one time the primary length of the unit cells (220). During the next two steps the print head (1) moves by another two times the same distance, resulting in the creation of two primitive lines (23) that consist of two layers each. Between the third and the fourth step, additional primitive lines are added while the print head (1) offsets along the secondary unit cell orientation, such as to create a patch. However, during the whole printing action, one whole nozzle row (54) was deactivated via its inner extraction electrode (51*b*) and therefore only six print pattern segments (21) have been created instead of nine. In the fourth step, the yet deactivated inner extraction electrode (51*b*) is also activated such that during printing of a first primitive line (23) in the subsequent two steps, all three nozzle rows (54) are only controlled by the triggering sequence of their outer extraction electrode (51*a*). Besides one new primitive line (23) that belongs to the yet unprinted print pattern segment (21), there are also created two primitive lines (23) on top of the already printed patch. For visual clarity, parts of the patch that already contain a second patch layer are drawn with a textured filling. Between the sixth and the seventh steps, further primitive lines (23) are added while further offsetting the print head (1) along the secondary unit cell orientation, eventually allowing each nozzle row (54) to complete a complete further patch layer. During the seventh step the inner extraction electrode (51*b*) of two nozzle rows (54) will be deactivated and only one nozzle row (54) will be allowed to add further material onto the substrate (4), such as to create a second patch layer onto the part of the patch that only contains one patch layer yet. Eventually it is shown in the last step the finalized patch that is thoroughly formed with two patch layers, each patch layer consisting of two primitive line layer, wherein each print pattern segment (21) is printed by equal use of four different nozzles (5). Because of the use of two extraction electrodes (51*a*, 51*b*), not every nozzle (5) must be controlled with an individual contact point. Hence, instead of nine, only six contact points were required in this example.

Figure 16:
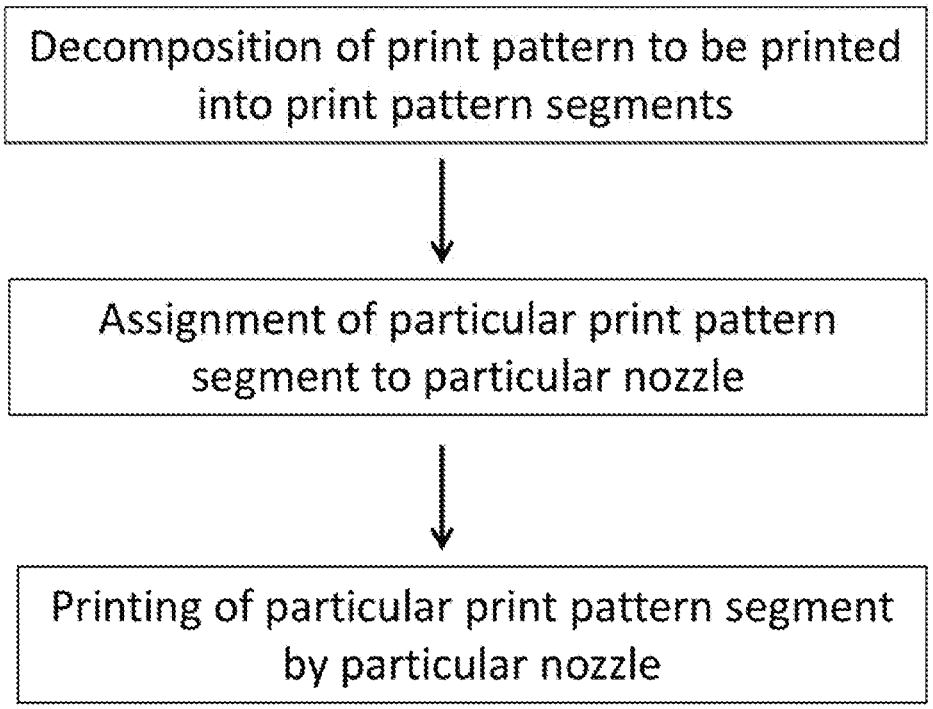
FIG. 16 schematically illustrates the method of printing a print pattern onto a substrate.

FIG. 16 schematically illustrates the method of printing a print pattern onto a substrate with a print head according to the present invention. The method comprises i) decomposing the print pattern into a plurality of print pattern segments; ii) assigning each print pattern segment to exactly one nozzle; and iii) causing each nozzle to print the print pattern segment assigned to said nozzle. During the printing of each print pattern segment, the print head is moved within an area that is smaller than the active print head area.

The invention claimed is:

1. A printing system for printing a print pattern onto a substrate, the printing system comprising a print head and a print controller, wherein the print head comprises:

at least one nozzle; and at least two extraction electrodes being associated with the at least one nozzle;

wherein the print controller is configured to jointly activate the extraction electrodes in order to cause an electrohydrodynamic ejection of droplets from said nozzle, wherein the print head comprises at least two conductive tracks that electrically contact the extraction electrodes, and wherein each conductive track is connected with a particular extraction electrode and terminates on a contact point.

2. The printing system according to claim 1, wherein the at least two extraction electrodes associated with the at least one nozzle terminate on different contact points, wherein the different contact points are configured to receive a first and a further triggering sequence.

3. The printing system according to claim 2, wherein at least one of the extraction electrodes connected to different contact points and the conductive tracks originating from different contact points are electrically insulated from each other.

4. The printing system according to claim 1, wherein the at least two extraction electrodes are at least one of arranged at a different axial distance from the at least one nozzle and arranged at a different radial distance from the at least one nozzle with respect to a longitudinal direction of the nozzle.

5. The printing system according to claim 1, wherein the at least two extraction electrodes are formed as ring electrodes that extend around the at least one nozzle.

6. The printing system according to claim 5, wherein the at least two extraction electrodes are formed with a different inner radius.

7. The printing system according to claim 1, further comprising at least two insulator layers, wherein in each case one extraction electrode is formed on one insulator layer.

8. The printing system according to claim 1 comprising at least two nozzles, wherein each extraction electrode is connected with a conductive track terminating on a contact point, and wherein one conductive track of one of the at least two nozzles and one conductive track of another of the at least two nozzles terminate on a common contact point.

9. The printing system according to claim 8, wherein the conductive tracks of nozzles terminating on the common contact point are merged into a single conductive track before being contacted to the common contact point.

10. A method of printing a print pattern onto a substrate with a print head comprising at least one nozzle and at least two extraction electrodes associated with said nozzle, the method comprising:

jointly activating the extraction electrodes to cause an electrohydrodynamic ejection of droplets from said nozzle, wherein at least one of:

i) the print heat comprises at least two conductive tracks that electrically contact the extraction electrodes, wherein each conductive track is connected with a particular extraction electrode and terminates on a contact point, and wherein voltages are applied to the extraction electrodes so as to cause the ejection of droplets; or ii) a voltage is applied to one of the at least two extraction electrodes and a further voltage is applied to the other of the at least two extraction electrodes, and wherein droplets are only ejected from the at least one nozzle if the voltages are supplied to both of the at least two extraction electrodes.

11. The method according to claim 10, wherein the at least two extraction electrodes associated with the at least one nozzle terminate on different contact points, wherein a first triggering sequence is applied to a first contact point and a further triggering sequence is applied to a further contact point, the superposed electric fields of the voltages conveyed by all the applied triggering sequences being above a minimal voltage necessary for the ejection of the droplets.

12. The method according to claim 10, wherein the print head comprises at least two nozzles, wherein each extraction electrode is connected with a conductive track terminating on a contact point, wherein one conductive track of one of the at least two nozzles and one conductive track of another of the at least two nozzles terminate on a common contact point, and wherein a common triggering sequence is applied to said nozzles via their common contact point.

13. The method according to claim 10, wherein the voltage and the further voltage are a voltage triggering sequence and a further voltage triggering sequence.

14. A printing system for printing a print pattern onto a substrate, the printing system comprising a print head and a print controller, wherein the print head comprises:

at least two nozzles; and at least four extraction electrodes;

wherein each nozzle is associated with at least two extraction electrodes, wherein each extraction electrode is connected with a conductive track terminating on a contact point, and wherein one conductive track of one of the at least two nozzles and one conductive track of another of the at least two nozzles terminate on a common contact point, and wherein the print controller is configured to jointly activate the extraction electrodes in order to cause an electrohydrodynamic ejection of droplets from said nozzle.

* * * * *